US011234520B2

(12) United States Patent
Stravitz et al.

(10) Patent No.: US 11,234,520 B2
(45) **Date of Patent: *Feb. 1, 2022**

(54) FURNITURE WITH LASHING MECHANISM

(71) Applicant: Dooli Products, LLC, New York, NY (US)

(72) Inventors: David M. Stravitz, New York, NY (US); Steven G. Marton, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/443,615

(22) Filed: Jul. 27, 2021

(65) Prior Publication Data

US 2021/0353063 A1 Nov. 18, 2021

Related U.S. Application Data

(60) Division of application No. 17/194,401, filed on Mar. 8, 2021, now Pat. No. 11,103,067, which is a (Continued)

(51) Int. Cl.

| | |
|---|---|
| ***A47B 95/00*** | (2006.01) |
| ***A47B 97/00*** | (2006.01) |
| ***A47B 91/12*** | (2006.01) |

(52) U.S. Cl.

CPC ..... *A47B 97/00* (2013.01); *A47B 91/12* (2013.01); *A47B 2097/008* (2013.01)

(58) Field of Classification Search

CPC ... A47B 97/00; A47B 91/12; A47B 2097/008; F16M 13/02

(Continued)

(56) References Cited

U.S. PATENT DOCUMENTS

| | | | |
|---|---|---|---|
| D22,730 | S | 8/1893 | Shoudy |
| D46,792 | S | 12/1914 | Purcell |

(Continued)

FOREIGN PATENT DOCUMENTS

| | | | |
|---|---|---|---|
| FR | 2620303 | A1 | 3/1989 |
| FR | 2979210 | A1 | 3/2013 |

(Continued)

OTHER PUBLICATIONS

No, Dressers Don't Need to be Anchored to a Wall, by John Brownlee, Jul. 13,206, downloaded Jan. 26, 2020.

(Continued)

*Primary Examiner* — Todd M Epps
(74) *Attorney, Agent, or Firm* — Brian Roffe

(57) ABSTRACT

Dresser includes a frame having a wall section forming a rear wall, and an upper panel that covers an accessible space. A bracket is designed for attachment to a vertical support, a first connector is attached to the bracket, a second connector is attached to the frame in a position to be in the space and removably engages with the first connector when present in the space under the upper panel. The first and/or second connector is/are length adjustable relative to its supporting structure, i.e., relative to the bracket in the case of the first connector or relative to the frame in the case of the second connector to enable a distance between the frame and the vertical support to be reduced. A reduction in distance between the frame and the vertical support and engagement between the first and second connectors prevents tipping of the piece of furniture.

20 Claims, 30 Drawing Sheets

Related U.S. Application Data continuation-in-part of application No. 17/094,979, filed on Nov. 11, 2020, now Pat. No. 10,939,761, which is a continuation-in-part of application No. 16/992,397, filed on Aug. 13, 2020, now Pat. No. 10,905,241, which is a continuation of application No. 16/986,932, filed on Aug. 6, 2020, now Pat. No. 10,813,456, which is a continuation-in-part of application No. 16/799,909, filed on Feb. 25, 2020, now Pat. No. 10,758,046, and a continuation-in-part of application No. 16/799,941, filed on Feb. 25, 2020, now Pat. No. 10,786,080.

(60) Provisional application No. 62/949,664, filed on Dec. 18, 2019, provisional application No. 62/944,425, filed on Dec. 6, 2019.

(58) Field of Classification Search
USPC ..... 248/309.1; 312/330.1
See application file for complete search history.

(56) References Cited

U.S. PATENT DOCUMENTS

| | | | | |
|---|---|---|---|---|
| 1,233,775 | A | 7/1917 | Hagar | |
| 1,376,203 | A | 4/1921 | Payne | |
| 1,730,391 | A | 10/1929 | Stobba | |
| 2,104,214 | A | 1/1938 | Vezina | |
| D182,833 | S | 5/1958 | Lubbert et al. | |
| D215,731 | S | 10/1969 | Solie | |
| 3,859,826 | A | 1/1975 | Singer et al. | |
| 4,120,549 | A | 10/1978 | Bureau | |
| D251,885 | S | 5/1979 | Tebbe et al. | |
| 4,214,323 | A | 7/1980 | Thomas | |
| D272,398 | S | 1/1984 | West | |
| D272,497 | S | 2/1984 | Kemp, III et al. | |
| 4,655,429 | A | 4/1987 | Gaenzle et al. | |
| 4,669,695 | A | 6/1987 | Chou | |
| 4,733,840 | A | 3/1988 | D'Amore | |
| D305,485 | S | 1/1990 | Zalesak | |
| 4,890,813 | A | 1/1990 | Johnson et al. | |
| 5,013,103 | A | 5/1991 | Addison | |
| 5,076,525 | A | 12/1991 | Whipple | |
| 5,174,543 | A | 12/1992 | Corson et al. | |
| D333,578 | S | 3/1993 | White | |
| 5,192,123 | A | 3/1993 | Wallin | |
| 5,197,706 | A | 3/1993 | Braithwaite et al. | |
| D339,938 | S | 10/1993 | Fisher | |
| D347,337 | S | 5/1994 | Keller | |
| 5,352,031 | A | 10/1994 | Nahrgang | |
| 5,431,365 | A | 7/1995 | Hopkins | |
| 5,599,000 | A | 2/1997 | Bennett | |
| D384,525 | S | 10/1997 | McBrayer et al. | |
| 5,794,903 | A | 8/1998 | Peterson, II | |
| D424,833 | S | 5/2000 | Zaidman | |
| 6,068,355 | A | 5/2000 | Thorp | |
| 6,220,562 | B1 | 4/2001 | Konkle | |
| D467,096 | S | 12/2002 | DiCostanzo | |
| 6,508,525 | B2 | 1/2003 | Picogna | |
| 6,533,238 | B2 | 3/2003 | Barnes et al. | |
| D473,401 | S | 4/2003 | de Blois | |
| D503,564 | S | 4/2005 | Juneau et al. | |
| D508,347 | S | 8/2005 | Juneau et al. | |
| D512,903 | S | 12/2005 | Gallien | |
| D514,846 | S | 2/2006 | McDiarmid | |
| D518,975 | S | 4/2006 | Mohundro | |
| 7,185,872 | B2 | 3/2007 | Lowenstein, Jr. | |
| D542,057 | S | 5/2007 | Juneau | |
| 7,287,820 | B2 | 10/2007 | Van Loon et al. | |
| D555,394 | S | 11/2007 | Sexton | |
| 7,325,281 | B1 * | 2/2008 | Willems | B60R 25/00 24/302 |
| D586,147 | S | 2/2009 | Tsay et al. | |
| D599,136 | S | 9/2009 | Jeup | |
| D605,742 | S | 12/2009 | Bock et al. | |
| D606,180 | S | 12/2009 | Bock et al. | |
| D606,634 | S | 12/2009 | Bock et al. | |
| D606,635 | S | 12/2009 | Bock et al. | |
| D611,267 | S | 3/2010 | Collette | |
| D617,117 | S | 6/2010 | Tovin | |
| 7,775,498 | B2 | 8/2010 | Phillips et al. | |
| D625,305 | S | 10/2010 | Bleck et al. | |
| 9,163,842 | B2 | 10/2015 | Adams et al. | |
| 9,578,965 | B2 | 2/2017 | Hamaba et al. | |
| D790,888 | S | 7/2017 | Everson et al. | |
| 9,955,785 | B2 | 5/2018 | Kato | |
| 10,113,687 | B2 | 10/2018 | Wise | |
| 10,321,762 | B2 | 6/2019 | Muskopf | |
| D862,135 | S | 10/2019 | Birch | |
| D867,791 | S | 11/2019 | Birch | |
| 10,524,572 | B2 | 1/2020 | Lercher | |
| 10,758,046 | B1 * | 9/2020 | Stravitz | A47B 97/00 |
| 10,786,080 | B1 | 9/2020 | Stravitz et al. | |
| 10,812,456 | B2 | 10/2020 | Pollet et al. | |
| 10,813,456 | B1 * | 10/2020 | Stravitz | A47B 91/12 |
| 10,856,659 | B1 * | 12/2020 | Stravitz | A47B 97/00 |
| 10,905,241 | B1 * | 2/2021 | Stravitz | A47B 91/12 |
| 10,912,384 | B2 * | 2/2021 | Lager | A44B 11/00 |
| 10,939,761 | B1 * | 3/2021 | Stravitz | A47B 88/57 |
| 11,103,067 | B2 * | 8/2021 | Stravitz | A47B 91/12 |
| 2003/0010886 | A1 | 1/2003 | Barnes et al. | |
| 2003/0221593 | A1 | 12/2003 | Usagani | |
| 2006/0097123 | A1 | 5/2006 | Gallien | |
| 2006/0207989 | A1 | 9/2006 | Ritchie et al. | |
| 2006/0265806 | A1 | 11/2006 | Stevenson | |
| 2007/0039640 | A1 | 2/2007 | Zheng | |
| 2009/0173848 | A1 | 7/2009 | Green | |
| 2011/0043088 | A1 | 2/2011 | McConnell et al. | |
| 2011/0169387 | A1 * | 7/2011 | Fowler | A47B 83/001 312/249.1 |
| 2013/0087675 | A1 * | 4/2013 | Miller | A47B 97/00 248/499 |
| 2014/0047693 | A1 | 2/2014 | Cassidy et al. | |
| 2014/0263925 | A1 | 9/2014 | Essrig | |
| 2015/0130339 | A1 | 5/2015 | Barnett | |
| 2015/0130342 | A1 | 5/2015 | Barnett | |
| 2017/0021958 | A1 | 1/2017 | Shelton | |
| 2018/0168344 | A1 | 6/2018 | Arrillaga Albeniz | |
| 2018/0209580 | A1 | 7/2018 | Wise | |
| 2019/0150617 | A1 | 5/2019 | Lager et al. | |
| 2019/0365098 | A1 | 12/2019 | Johannesson | |
| 2020/0359795 | A1 | 11/2020 | Maltais | |
| 2020/0383476 | A1 | 12/2020 | Marsden | |
| 2021/0007485 | A1 | 1/2021 | Marsden | |

FOREIGN PATENT DOCUMENTS

| | | | |
|---|---|---|---|
| JP | 3014942 | U | 8/1995 |
| KR | 200484018 | Y1 | 7/2017 |
| KR | 10194900 | B1 | 2/2018 |
| RU | 2315537 | C2 | 1/2008 |
| WO | 0024293 | A1 | 5/2000 |

OTHER PUBLICATIONS

DE20116637 Zerver; Abstract and figure (2001).
CN209474157 Chang et al.; Abstract and figure (2019).
English translation FR 2620303, 1989.
International Search Report for PCT/US2020/063547 dated Mar. 25, 2021.
Written Opinion for PCT/US2020/063547 dated Mar. 25, 2021.
Gerridan Chest of Drawers from ashleyfurniture.com, retrieved date Jun. 10, 2021, p. 1 from www.ashleyfurniture.com/p/gerridan_chest_of_drawers/B1190-44.html (Year 2021).

* cited by examiner

FURNITURE WITH LASHING MECHANISM

CROSS-REFERENCE TO RELATED APPLICATIONS

This application is a divisional of U.S. patent application Ser. No. 17/194,401 filed Mar. 8, 2021, which is a continuation-in-part of U.S. patent application Ser. No. 17/094,979 filed Nov. 11, 2020, now U.S. Pat. No. 10,939,761, which is a continuation-in-part of U.S. patent application Ser. No. 16/992,397 filed Aug. 13, 2020, now U.S. Pat. No. 10,905,241, which is a continuation of U.S. patent application Ser. No. 16/986,932 filed Aug. 6, 2020, now U.S. Pat. No. 10,813,456, which is a continuation-in-part of U.S. patent application Ser. No. 16/799,909 filed Feb. 25, 2020, now U.S. Pat. No. 10,758,046, and also a continuation-in-part of U.S. patent application Ser. No. 16/799,941 filed Feb. 25, 2020, now U.S. Pat. No. 10,786,080, and U.S. patent application Ser. No. 16/799,909 claims the benefit under 35 U.S.C. § 119 of U.S. provisional patent application Ser. No. 62/944,425 filed Dec. 6, 2019, and U.S. provisional patent application Ser. No. 62/949,664 filed Dec. 18, 2019, all of which are incorporated by reference herein.

This application is also related to, on the grounds that it includes common disclosure as, U.S. patent application Ser. No. 16/935,335 filed Jul. 22, 2020, now U.S. Pat. No. 10,856,659, which is also incorporated by reference herein.

FIELD OF THE INVENTION

The present invention relates generally to anti-tipping mechanisms for furniture that prevent the furniture from tipping over when, for example, a child is climbing on a drawer of the furniture or reaching the top to have it tip forward. The anti-tipping mechanisms may be completely separate from the furniture or involve specific construction of the furniture. The present invention also relates to a piece of furniture including or incorporating an anti-tipping mechanism, and a method for placing or installing a piece of furniture to provide anti-tipping properties.

BACKGROUND OF THE INVENTION

Furniture tipping accidents and deaths are on the rise. The majority many of toddler furniture pieces, typically dressers, are anywhere from about 16 inches to about 24 inches deep and often toddlers can grab the top of the dresser, grab the top drawer of the dresser and even climb into the bottom drawer of the dresser before the parent is aware of this. Top drawers of these dressers often have heavy contents in them further making the dresser more easy to tip over, which when it occurs, often results in the toddler getting severely hurt, sometimes even rushed to the hospital and even more worrisome, a tragic death.

Many products on the market currently offer the ability to attach the upper back of a piece of furniture, e.g., a dresser, to the wall or other vertical support behind the dresser with a webbing strap or cable so the tipping issue is caught and restricted before the entire dresser falls forward. Yet, this can also allow the topmost dresser drawer to fall forward and still cause accidents. Proper fastening of the dresser to the wall poses yet another issue insofar as it is possible that the screws on the wall or the screws on the dresser are ripped apart when the tipping force is too much, especially if the webbing strap or cable is not attached properly in a safe or secure manner and location. After all, most dresser backs are very cheaply made with the backs often ⅛" thin pressboard or plywood and the frame is typically ⅝"-¾" and made of plywood or even less secure presswood typically used today.

Also, it is possible that the wall mounting was installed without the use of appropriate hardware such as mollies or lead plugs. If that were so, it would take little force for the tipping force exerted by the child or toddler to "rip" a wall-mounting bracket right off the wall thus allowing the dresser to continue its fall. Furthermore, if the frame is presswood, it would not take much force to "rip off" the mounting screws securing the webbing or cable to the frame or back.

OBJECTS AND SUMMARY OF THE INVENTION

It is an object of at least one embodiment of the present invention to provide new and improved mechanisms for integrating or incorporating into pieces of furniture to prevent the furniture from tipping over.

It is another object of at least one embodiment of the present invention to provide a mechanism to significantly resist a baby or toddler from forcefully engaging an upper region of a dresser while approaching the dresser with an adequate stance to effect the possibility of causing danger to the baby or toddler.

It is yet another object of at least one embodiment of the present invention to provide a dresser that resists tipping when a top drawer of the dresser is open.

It is still another object of at least one embodiment of the present invention to provide a dresser that resists tipping when the toddler physically engages an open bottom drawer of the dresser or reaching the upper region of the dresser and pulling (tipping) it forward.

Another object of at least one embodiment of the present invention is to provide a dresser that resists tipping even when the toddler climbs on or into a bottom drawer region of the dresser.

A dresser having an anti-tipping mechanism in accordance with one embodiment of the invention includes a frame including the substantially planar wall section having front and rear surfaces defining a thickness therebetween and which forms at least part of a rear wall of the piece of furniture. The frame also includes an upper panel that defines an opening and an access door that controls access through the opening to a space under the upper panel. The dresser also includes a bracket attachable to a vertical support, a first connector attached to the bracket, with an aperture in the wall section being dimensioned to enable passage of the first connector therethrough into the space under the upper panel. A second connector is attached to the frame in a position to be in the space below the upper panel and that removably engages with the first connector when both are present in the space under the upper panel. The first and/or second connector is length-adjustable relative to its supporting structure, i.e., relative to the bracket in the case of the first connector or relative to the frame in the case of the second connector to enable a distance between the frame and the bracket to be adjusted, particularly at least reduced. A reduction in distance between the frame and the bracket, when the bracket is attached to the vertical support, and engagement between the first and second connectors prevents tipping of the piece of furniture.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

One of the inventors' ideas to address the tipping problem of furniture in the presence of toddlers and children is that it is advantageous, instead of addressing attachment of a dresser or other piece of furniture to the wall against which it is placed, to address stability and retention of support legs of the furniture by attaching extensions or boots at least partly under and to the support legs to provide superior anti-tipping characteristics (for toddlers, parents, even TV stands). The extensions (having a form similar in appearance to a boot) provide a 16-18 inch deep dresser the ability to function as if it were 24-28 inches (depending on the length of the extensions). Various boots or extensions are disclosed below.

In the embodiments disclosed herein, a dresser including a plurality of drawers is often used as an example of a piece of furniture for which the anti-tipping mechanism may be used, and in which an anti-tipping mechanism may be integrated or incorporated. The anti-tipping mechanisms of the invention can be used on other types of furniture in addition to dressers and are not limited to use with only dressers. Also, the dressers may include one or more drawers in any of the sections therein.

Figure 1:
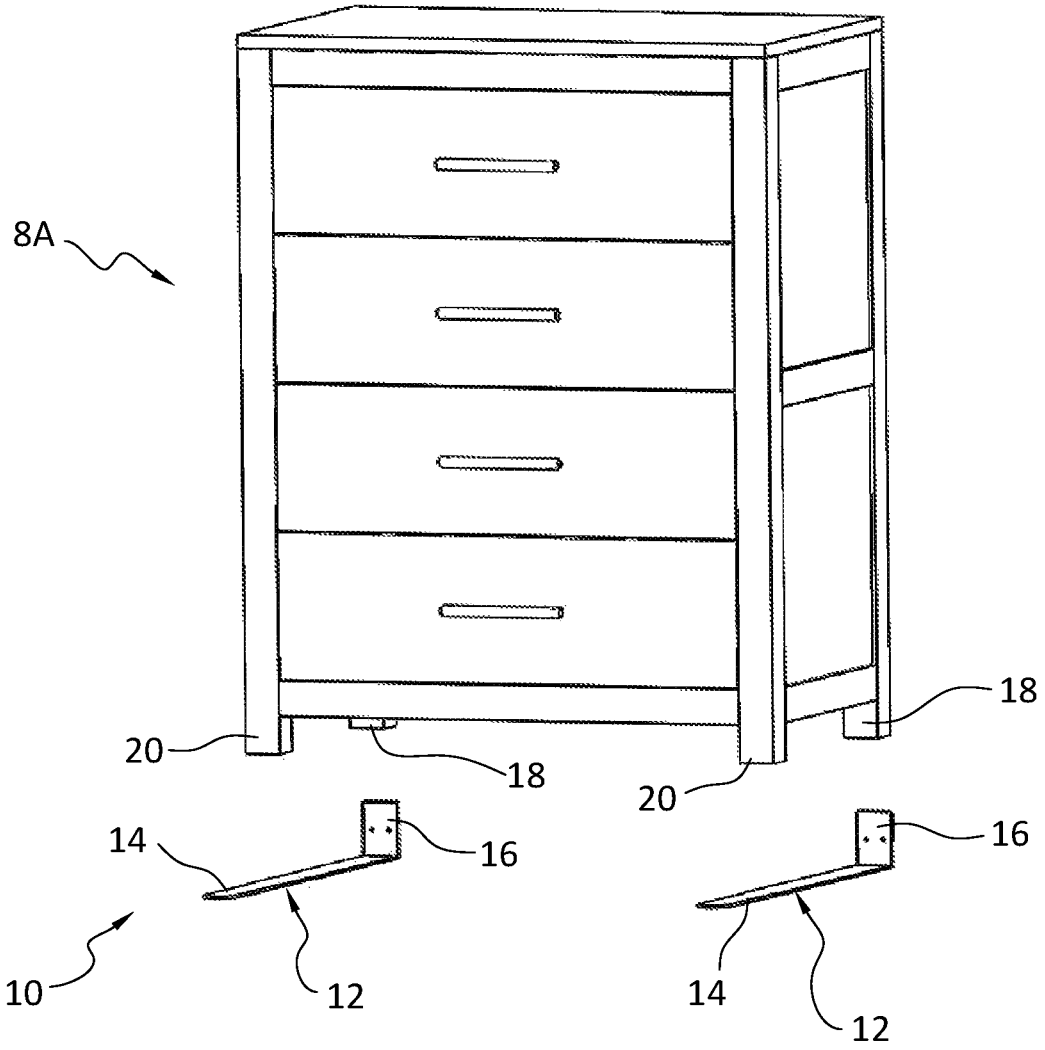
FIG. 1 is a perspective view of a dresser including a first embodiment of an anti-tipping mechanism in accordance with the invention shown detached from the dresser.
Figure 2:
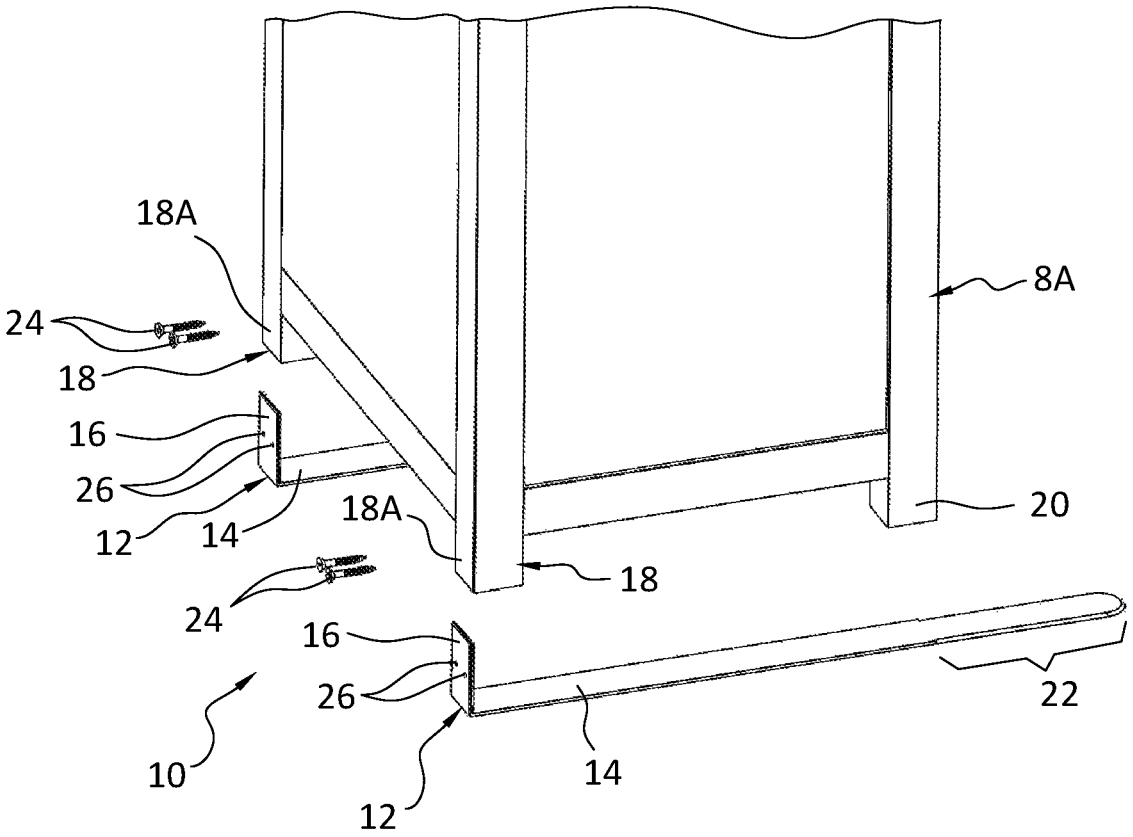
FIG. 2 is a rear perspective view of the dresser shown in FIG. 1 with the anti-tipping mechanism shown detached from the dresser.
Figure 3:
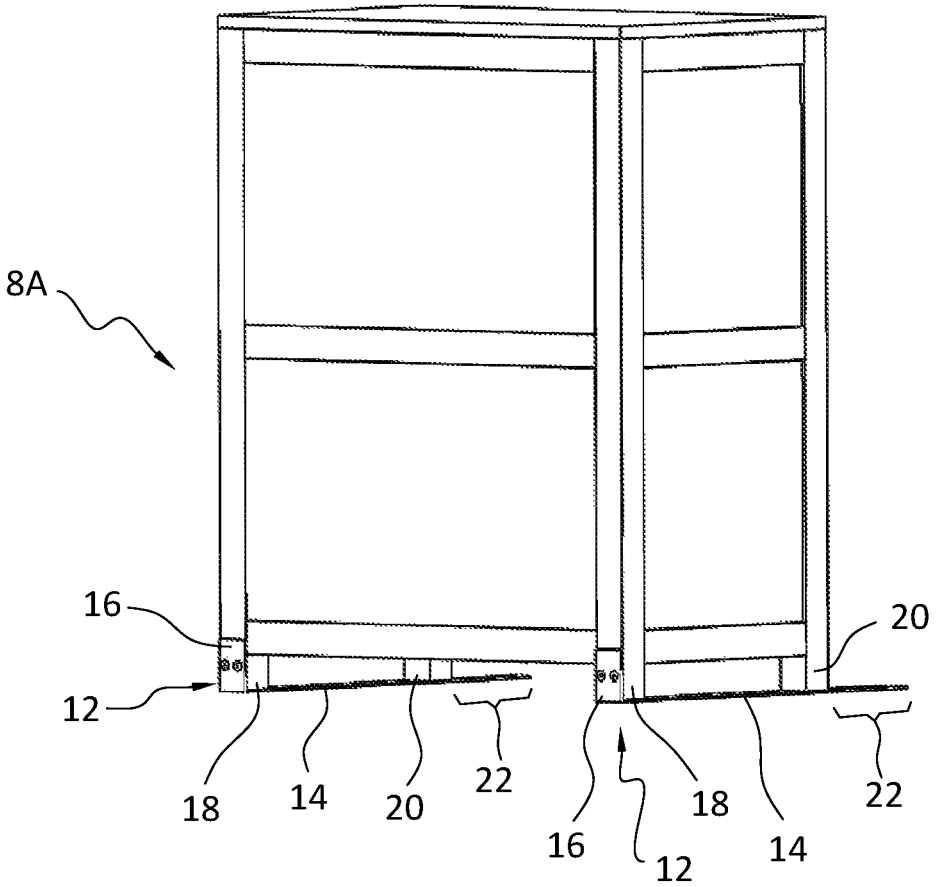
FIG. 3 is a rear view of the dresser shown in FIG. 1 with the anti-tipping mechanism attached to the dresser.

FIGS. 1-3 show a dresser 8A including a first embodiment of an anti-tipping mechanism in accordance with the invention designated generally as 10. Anti-tipping mechanism 10 includes a fixed angled L-shaped extension or boot 12 that has a first planar portion 14 and a second planar portion 16 at a fixed angle relative to the first planar portion 14. The planar portions 14, 16 may be rigid and permanently attached to one another so that the angle between them is not variable. The planar portions 14, 16 may be solid or hollow or have any construction that enables them to support the dresser 8A without being damaged. Also, the planar portions 14, 16 may be made of a sturdy, supportive material such as a type of metal such as stainless steel or electroplated carbon, etc. with 14 or 16 gauge as examples, or unbreakable plastic such as polycarbonate (for clear parts) or rigid nylon or Delrin (Acetal) for solid colors. Ideally, the plastic parts would have typical wall thicknesses ranging from about ⅛ inches to about 3⁄16 inches.

The first planar portion 14 is elongate and dimensioned relative to the dresser 8A (FIG. 1) it is to be used with so that when the second planar portion 16 attached to a rear surface 18A of a rear leg 18 of the dresser 8A, the first planar portion 14 extends a distance beyond the front leg 20 (this distance being represented as 22, see FIGS. 2 and 3). As such, it is envisioned to make a plurality of different L-shaped boots 12 to fit different sizes of dressers 8A. The legs 18, 20 are not required for a piece of furniture and may be provided by portions of a frame of the piece of furniture, i.e., leg portions of the frame, in which case, there may be a solid wall on the right and left sides of the frame with the L-shaped boot 12 being attached to the rear surface of the frame.

The angle between the first and second planar portions 14, 16 is dependent on the angle between the rear surface 18A of the rear leg 18 and the often horizontal surface on which the dresser 8A is to be placed. As shown, the fixed angle is about 90°, i.e., the second planar portion 16 is perpendicular to the first planar portion 14 which is to rest on the horizontal surface. The reason for this in the illustrated embodiment is because the bottom surface of the rear leg 18 is designed to lie flat against the horizontal surface when the dresser 8A is placed on the horizontal surface (of the L-shaped boot 12 were not present) and the rear surface 18A of the rear leg 18 is perpendicular to the bottom surface of the rear leg 18.

The angle however is determined by the shape of the rear leg 18 and specifically, the angle between the bottom surface of the rear leg 18 and the rear surface 18A of the rear leg 18 since it is desired that the surface of the second planar portion 16 be alongside and in contact with the rear surface 18A of the rear peg 18 after installation and during use. Another embodiment described below (FIGS. 4-6) provides for variability of the anti-tipping mechanism to addressed different angles.

The second planar portion 16 is attached to the rear surface 18A of the rear leg 18 to be in contact therewith by any suitable attachment means which provide a secure attachment of the L-shaped boot 12 to the rear leg 18. The anti-tipping mechanism 10 therefore comprises the boot 12 and the attachment means to attach the boot 12 to a piece of furniture.

As shown in FIG. 2, the attachment means comprise screws 24 which fit through apertures 26 in the second planar portion 16. One skilled in the art would appreciate that different attachment means may be used providing either a temporary or permanent attachment, e.g., nails or bolts. The attachment means should be selected to avoid separation of the rear leg 18 from the second planar portion 16 when a tipping force is exerted as this would frustrate the purpose of the L-shaped boots 12. Attachment means therefore may be construed as structure that provides for a secure attachment of one component to another component when a force is exerted on the other component. If bolts are used, a threaded insert may be pre-drilled and inserted in the rear of the rear leg 18. A screw, on the other hand, may be screwed into a starting hole formed in the rear leg 18.

In an exemplifying, non-limiting use, the L-shaped boot 12 may be attached to each rear leg 18 of the dresser 8A (see FIG. 3). The specific size L-shaped boot 12 is selected so that the first planar portion 14 thereof extends forward of the front leg 20. The longer the extension 22 of the first planar portion 14 forward of the front leg 20, the greater the resistance of the dresser 8A to tipping. In an attempt to tip the dresser 8A, there would be a downward force exerted against the extended portion 22 of the first planar portion 14 forward of the front leg 20 and this would hinder tipping of the dresser 8A.

One skilled in the art would be able to determine the distance of the extended portion 22 of the first planar portion 14 forward of the front leg 20 relative to characteristics of the dresser 8A, e.g., the height of the dresser 8A, the depth of the dresser 8A, the weight of the dresser 8A, and the number of drawers in the dresser 8A. As an example, if the dresser 8A has seven drawers, and is five feet high and nineteen inches deep (such dimensions being typical of a tippable dresser), then the L-shaped boots 12 should extend a number of inches forward of the dresser 8A to provide tip resistance. The more forward the L-shaped boots 12 extend, the more resistance to tip is provided to the dresser 8A.

The extended portion 22 has edges that may be contoured, e.g., curved and tapered to present a smooth surface as someone might walk over the extended portion 22. The front edge of the extended portion 22, i.e., the front edge of the first planar portion 14 of the L-shaped boot 12 may be in the shape of a semi-circular. It is envisioned that in some uses, the extended portion 22 is positioned underneath carpet or other floor covering to hide the extended portion 22. Placing them under a firm carpet may further assist in resisting tipping.

Boots 12, and other boots or extensions disclosed herein can be produced in plastic, as well as metal. In plastic, there can be the nice tapered edges on the front of the parts, however, if produced from metal, it may be desirable to use a typical stock of 16 gauge (0.060") or 14 gauge (0.0781") stainless steel or electroplated carbon steel. The boots 12 may be constructed with or without any edges being tapered, and with a rounded or square front, etc.

The invention also encompasses the combination of a piece of furniture, i.e., dresser 8A, and an anti-tipping mechanism, i.e., one or more of the L-shaped boots 12. Such a combination includes a frame having a front, and a rear. At least one drawer is slidable through the front of the frame into and partly out of the frame (not numbered in FIG. 1). The second planar portion 16 is attached to a rear surface of the frame, not specifically to the rear leg 18 since the rear leg 18 may not be present for all pieces of furniture with which the invention may be used, and when so attached, the second planar portion 16 is alongside and in contact with the rear surface of the frame (see FIG. 3). The first planar portion 14 is situated below the front and rear of the frame and has a size to extend forward of the front of the frame when the second planar portion 16 is attached to the rear surface of the frame to aid in preventing tipping of the dresser 8A (see FIGS. 1-3).

In the non-limiting illustrated embodiment, the frame includes a front leg 20 at the front of the frame and a rear leg 18 at a rear of the frame spaced apart from one another to provide a space between a front surface of the rear leg 18 and a rear surface of the front leg 20. In this case, the first planar portion 16 is below the front leg 20 and the rear leg 20, and possibly in contact with the lower/bottom surfaces of the rear and front legs 18, 20. When the dresser 8A has four legs as shown, two L-shaped boots 12 are used, one for each set of front/rear legs.

However, a single L-shaped boot may be used, as described below in connection with FIG. 11A wherein the first planar portion of the singular L-shaped boot is below, and possibly in contact with, the lower/bottom surfaces of both front legs 20 and the lower/bottom surfaces of both rear legs 18.

When the dresser or other piece of furniture does not have any legs that extend below the lower surface of the frame of the piece of furniture, then the front and rear lower support surfaces are formed by the lower surface of the frame that is configured to rest on and in contact with a horizontal surface supporting the piece of furniture. Alternatively, there may be side supports that extend from the front to rear of the frame along its sides and these side supports provide the front and rear lower support surfaces of the frame. The L-shaped boots 12 are therefore below the front and rear of the frame, and possibly in contact with the lower/bottom surfaces of the frame that would otherwise be in contact with the floor or other horizontal surface on which the piece of furniture is placed. The front of the frame is the front facing region where the front panels of the drawers are, while the rear of the fame is the rear facing region designed to abut against a wall or other vertical support.

Figure 4:
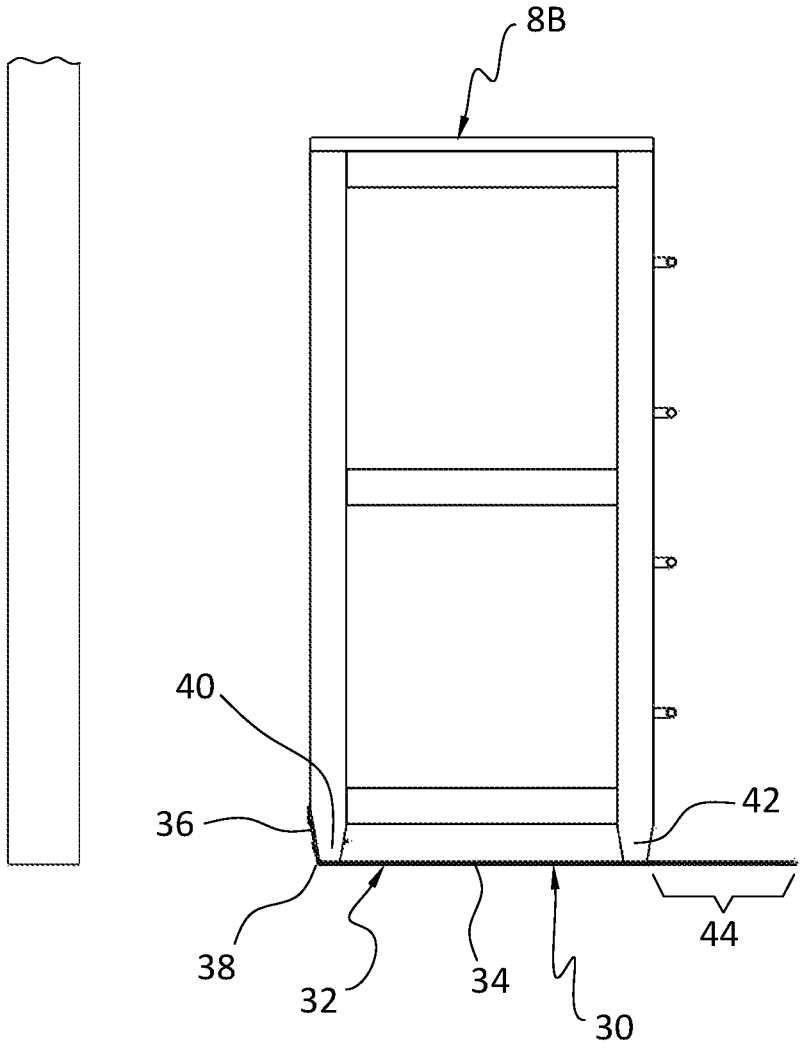
FIG. 4 is a side view of a dresser including a second embodiment of an anti-tipping mechanism in accordance with the invention shown attached to the dresser.
Figure 5:
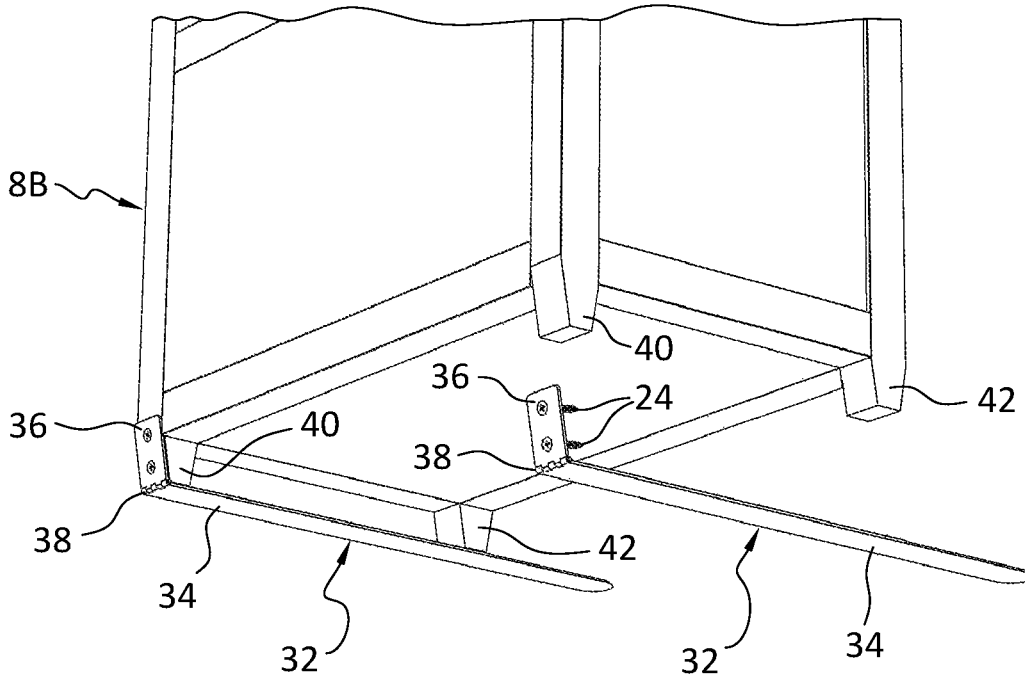
FIG. 5 is a rear perspective view of the dresser shown in FIG. 4 with the anti-tipping mechanism shown attached to the dresser.
Figure 6:
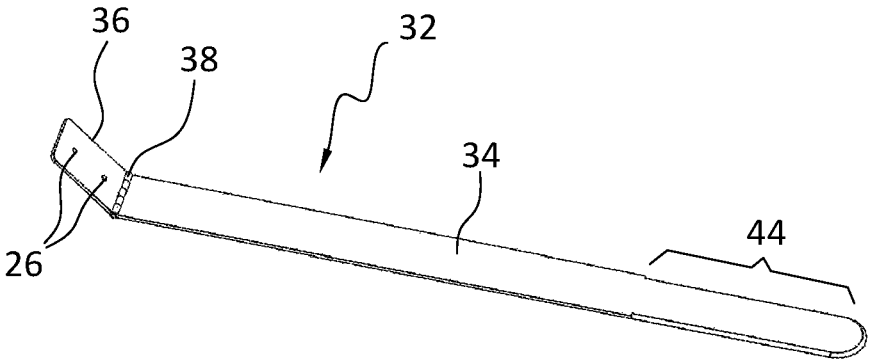
FIG. 6 is a perspective view of a part of the second embodiment of the anti-tipping mechanism.

FIGS. 4-6 show another anti-tipping mechanism in accordance with the invention which is designated 30 and includes an extension or boot 32 having first and second planar portions 34, 36 that are not rigidly fixed to one another (as in boot 12 in FIGS. 1-3), but rather are pivotally connected to one another by a hinge mechanism 38. Hinge mechanism 38 allows the second planar portion 36 to move to different angles and different angular positions relative to the first planar portion 34.

A primary advantage of the use of hinge mechanism 38 rotatably connecting the first and second planar portions 34, 36 is to account for different angles between the bottom surface of the rear leg 40 and the rear surface of the rear leg 40 of the dresser 8B. In the embodiment of FIGS. 1-3, this angle was about 90 degrees, but sometimes in actuality, the angle is different than 90 degrees, usually greater than 90 degrees. For example, as shown in FIGS. 4 and 5, the angle is about 110 degrees. Therefore, use of the fixed angle L-shaped boot 12 is not possible for the dresser 8B shown in FIGS. 4 and 5. Rather, variable angle, hinged boot 32 must be used. Hinged boot 32 has the advantage over the boot 12 insofar as it will accommodate most angles of the rear legs 40. It is estimated that fixed 90 degree boots, i.e., boot 12, will fit about 75% to about 90% of all existing dressers.

The first planar portion 34 is elongate and dimensioned relative to the dresser 8B, or other piece of furniture it is to be used with, so that when attached to the rear surface of the rear leg 40, the first planar portion 34 extends a distance beyond the front leg 42, this distance being represented as 44, see FIGS. 4 and 5. As such, it is envisioned to make a plurality of different boots 32 to fit different sizes of dressers 8B.

The planar portions 34, 36 may be solid or hollow or have any construction that enables them to support the dresser 8B without being damaged. Also, the planar portions 34, 36 may be made of a sturdy, supportive substantially unbreakable material.

In use, the angle to which the second planar portion 36 is pivoted relative to the first planar portion 34 is dependent on the angle between the rear surface of the rear leg 40 and the horizontal surface on which the dresser 8B is to be placed. The angle is thus determined by the shape of the rear leg 40 and specifically, the angle between the bottom surface of the rear leg 40 and the rear surface of the rear leg 40.

Hinge mechanism 38 may be any conventional hinge or pivot-providing structure that enables movement of one member relative to another to different angular positions. In a basic construction, hinge mechanism 38 includes a first part attached to the first planar portion 34 and a second part attached to the second planar portion 36 and one or more pivot pins between these parts, and possibly attached to only one of the parts.

The second planar portion 36 could, in a storage or shipping state, be pivoted against the first planar portion 34, i.e., the forward-facing surface of the second planar portion 36 is against the upper surface of the first planar portion 34, and then for installation, raised from this position to the necessary angle. The installer would position the second planar portion 36 against the rear surface of the rear leg 40 and then attach the screws 24 through apertures (which apertures 26 can be seen in FIG. 6), or using other attachment means. The anti-tipping mechanism 30 therefore comprises the boot 32 and the attachment means to attach the boot 32 to a piece of furniture.

In an exemplifying, non-limiting use, a boot 32 may be attached to each rear leg 40 of the dresser 8B (see FIG. 5). The specific size boot 32 is selected so that the first planar portion 34 thereof extends forward of the front leg 42. The longer the extension 44 of the first planar portion 34 forward of the front leg 42, the greater the resistance of the dresser 8B to tipping. In an attempt to tip the dresser 8B, there would be a downward force exerted against the extended portion 44 of the first planar portion 34 forward of the front leg 42 and this would hinder tipping of the dresser 8B.

One skilled in the art would be able to determine the distance of the extended portion 44 of the first planar portion 34 forward of the front leg 42 relative to characteristics of the furniture, e.g., the height of the dresser 8B, the depth of the dresser 8B, the weight of the dresser 8B, and the number of drawers in the dresser 8B. As an example, if the dresser 8B has seven drawers, and is five feet high and nineteen inches deep (such dimensions being typical of a tippable dresser), then the boots 32 should extend a number of inches forward of the dresser 8B to provide tip resistance.

Each planar section 34, 36 may have a wall thickness between about 0.100 inches and about 0.187 inches for flex resistance and rigidity. The boot 32 may be produced from sturdy unbreakable polycarbonate, e.g., for clear parts, Nylon, glass filled ABS and Acetal for opaque engineering thermo-plastics.

The extended portion 44 has edges that may be contoured, e.g., curved and tapered to present a smooth surface as someone might walk over the extended portion 44. The front edge of the extended portion 44, i.e., the front edge of the first planar portion 34 of the L-shaped boot 32 may be in the shape of a semi-circular and tapered down to an edge to resist possibly accidental tripping. It is envisioned that in some uses, the extended portion 44 is positioned underneath carpet or other floor covering to hide the extended portion 44. Ideally, this soothes things out and eliminates the chance of tripping.

FIGS. 7-11 show another embodiment of an anti-tipping mechanism designated 50 and which includes a different extension or boot 52 than either boot 12 or boot 32, but also includes attachment means. Differing from boot 32, boot 52 includes a first planar portion 54 that has a variable height, with the largest height at the end of extended portion or extension 56 and the smallest height at or proximate the edge adjacent the hinge mechanism 38 (see FIG. 9). The height may vary uniformly from the end of extension 56 to the hinge mechanism 38. Such a variable height planar portion 54 could nevertheless be provided on boot 12 if so desired.

Figure 10:
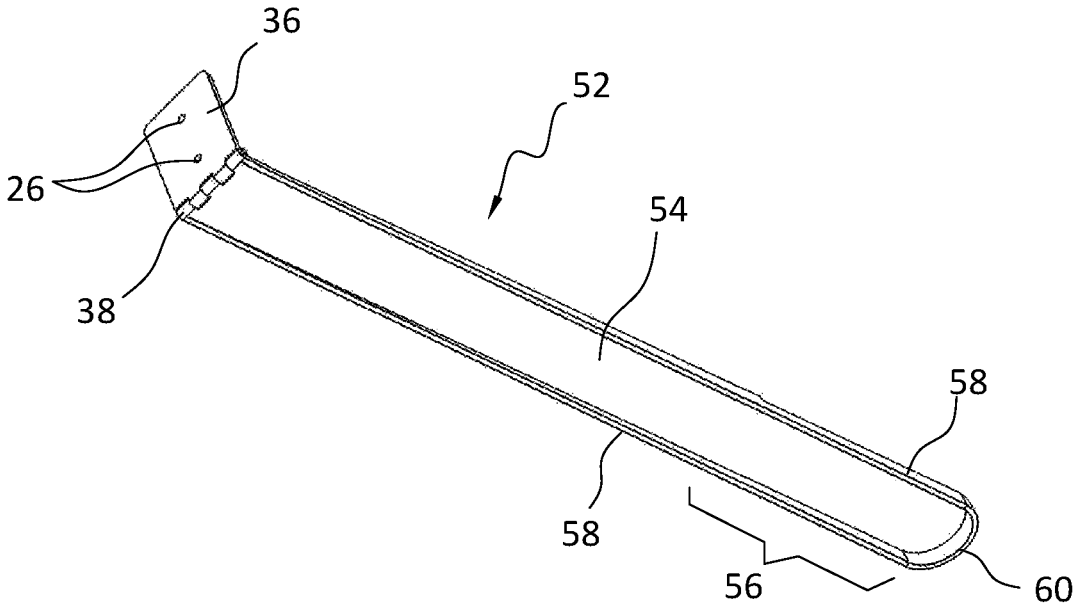
FIG. 10 is a bottom perspective view of a part of the third embodiment of the anti-tipping mechanism.

In the illustrated embodiment, the boot 52 has elongate, straight side ribs 58 and a front rib 60 connecting the front ends of the side ribs 58 to provide a horizontal support surface at a lower edge of the first planar portion 54 (see FIG. 10). The first planar portion 54 thus overlies a hollow cavity defined by the lower surface of the first planar portion 54 at the top, the inner surface of the side ribs 58 on the lateral sides, and the inner surface of the front rib 60 at the front, and possibly by the hinge mechanism 38 at the rear. Alternatively, the first planar portion 54 may be a solid.

Figure 7:
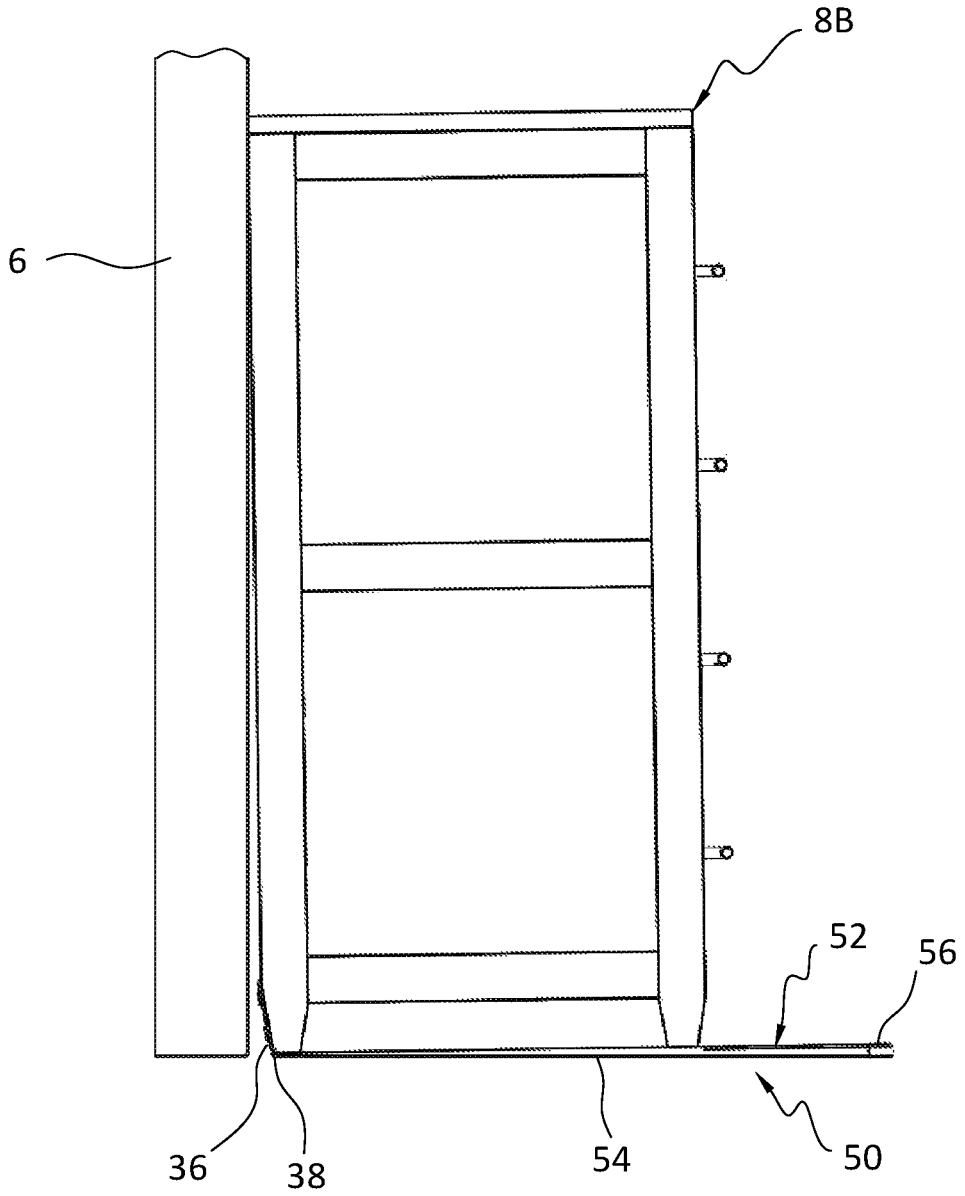
FIG. 7 is a side view of a dresser including a third embodiment of an anti-tipping mechanism in accordance with the invention shown attached to the dresser.
Figure 8:
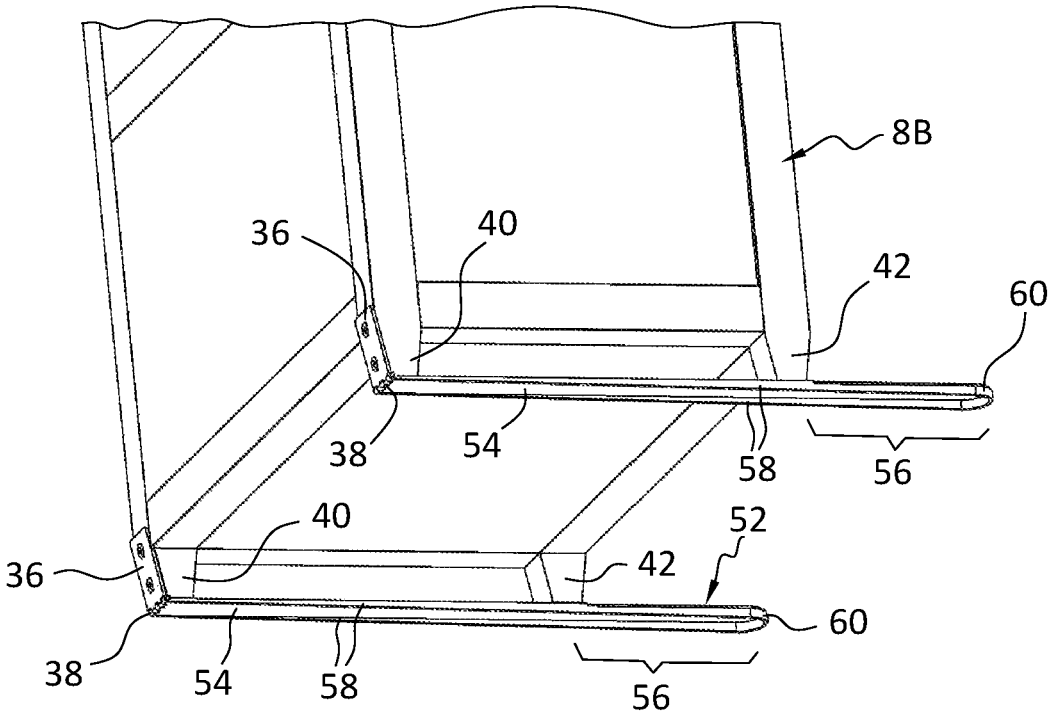
FIG. 8 is a rear perspective view of the dresser shown in FIG. 7 with the anti-tipping mechanism shown attached to the dresser.
Figure 9:
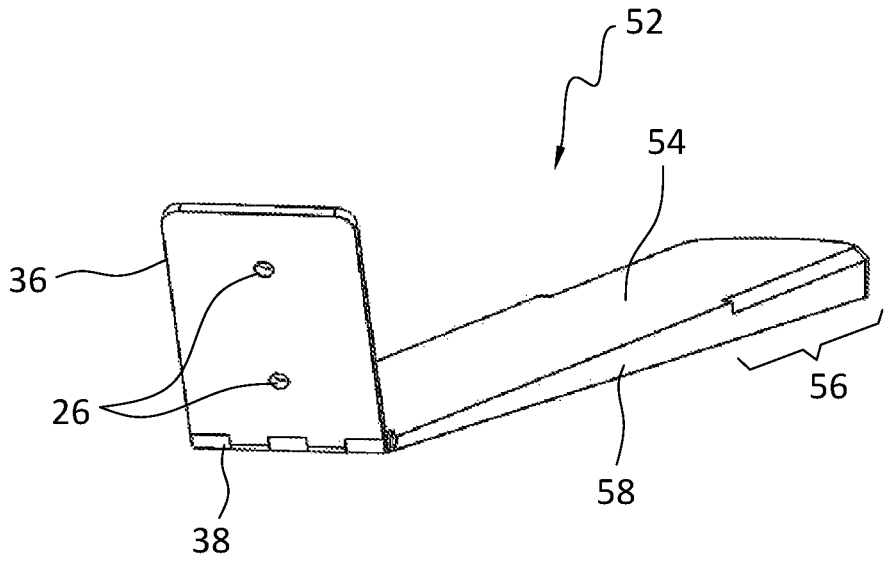
FIG. 9 is a top perspective view of a part of the third embodiment of the anti-tipping mechanism.
Figure 11:
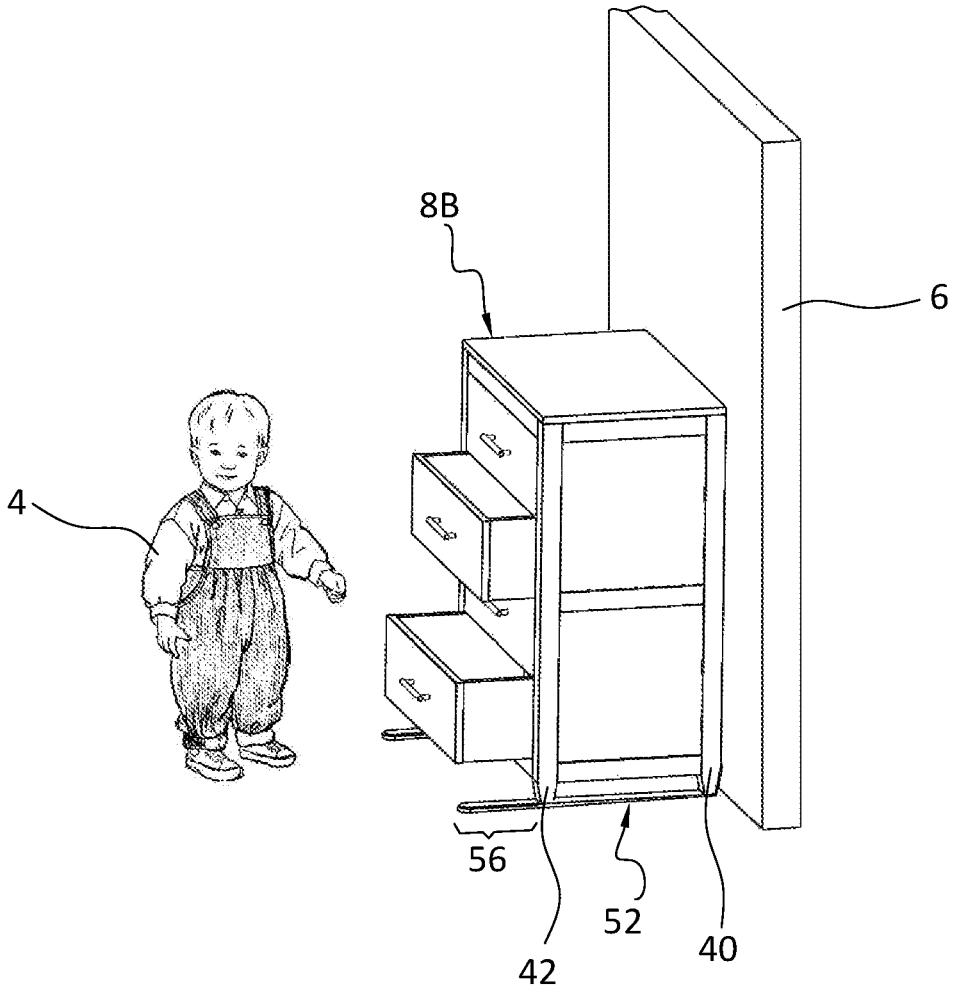
FIG. 11 is a side view of the dresser shown in FIG. 7 with a toddler in front potentially about to try to tip over the dresser.

This variable height results in the dresser 8B, when placed with its rear leg 40 and front leg 42 on the boot 52 as shown in FIGS. 7, 8 and 11, being slightly tilted rearward so that it is able to come into contact with a vertical wall 6 against which it is placed only at an upper portion (see in particular FIG. 7). Dresser 8B will not come into contact with the vertical wall 6 at the lower portion but rather will be spaced apart from the vertical wall 6 at the lower portion (see FIG. 7). The distance between the wall 6 and the rear of the dresser 8B increases in the direction from the top of the dresser 8B to the bottom of the dresser 8B. This rearward slanting of the dresser 8B resulting from the variable height boot 52 improves the tip resistance when a toddler or child 4 may try to pull the front of the dresser 8B (see FIG. 11).

The extension 56 has edges that may be contoured, e.g., curved to present a smooth surface as someone might walk over the extension 56. It is envisioned that in some uses, the extension 56 is positioned underneath carpet or other floor covering to hide the extension 56.

In the embodiments described above, the boots 12, 32, 52 are attached to the rear surface of the rear leg of the furniture. These uses are exemplifying only and do not limit the use of the boots 12, 32, 52. In some embodiments, it is envisioned that the boots 12, 32, 52 may be attached to another part of the furniture, e.g., the rear panel or rear wall of the furniture. In such cases, the legs 12, 32, 52 may extend forward of the front wall or front panel of the furniture at a location between the front legs, essentially sticking out in a middle region of and below the front wall or front panel. A single boot 12, 32, 52 may be used in these situations and would not be connected to the rear legs. The same attachment mechanism, e.g., screws, may be used to attach the boot 12, 32, 52 to the rear panel or rear wall of the furniture.

Figure 11A:
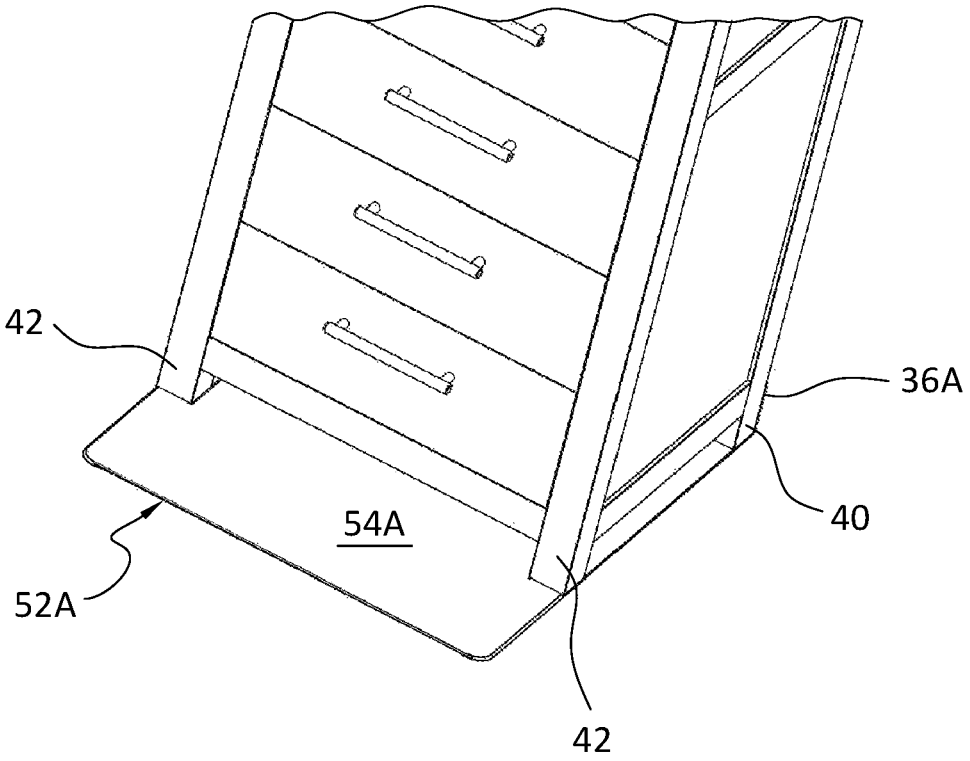
FIG. 11A is a perspective view of the dresser shown in FIG. 7 with a variant of the anti-tipping mechanism.
Figure 11B:
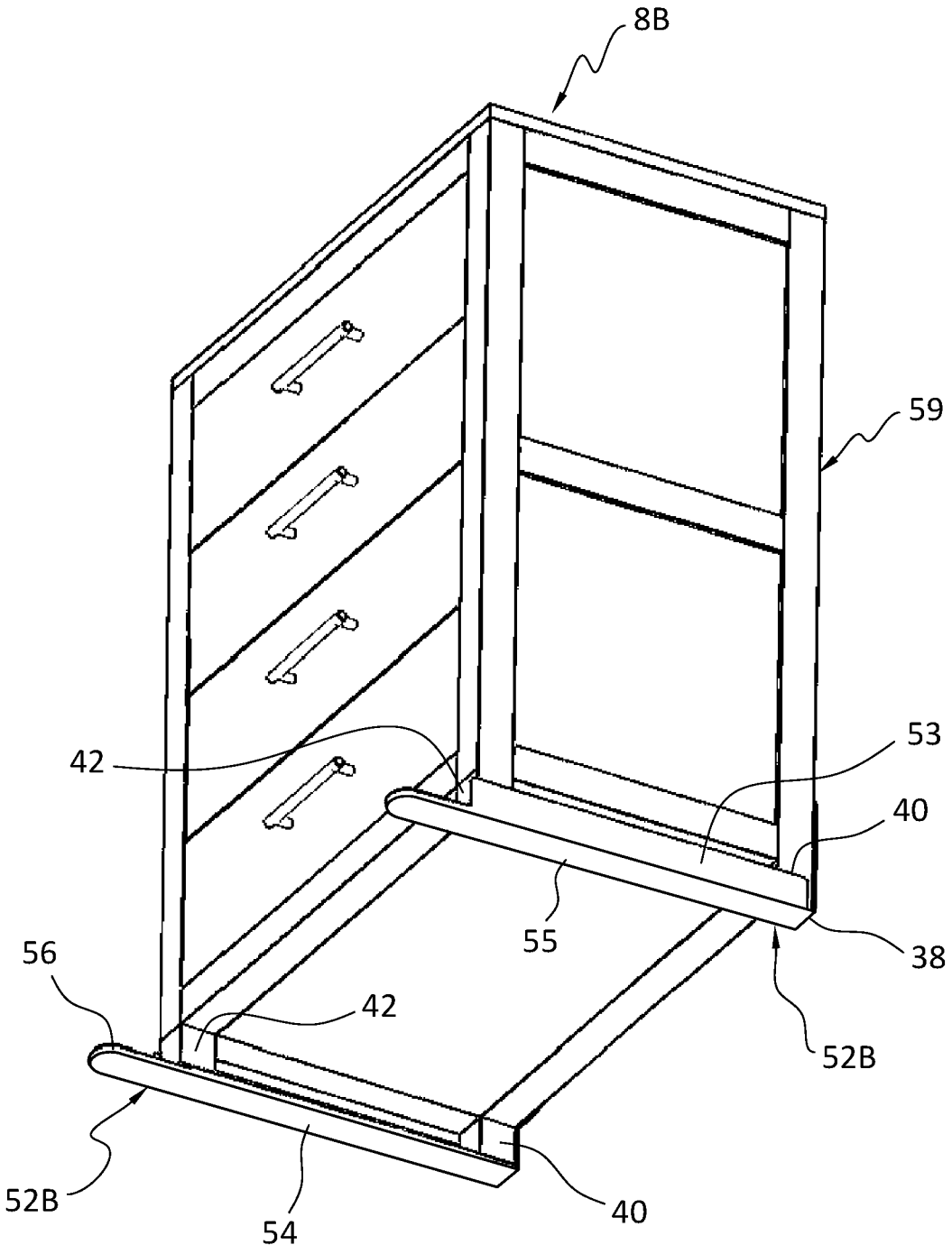
FIG. 11B is a front, bottom perspective view of a dresser with another embodiment of an anti-tipping mechanism in accordance with the invention.

As shown in FIG. 11A, another embodiment wherein a single boot 52A is used is illustrated. This single boot 52A may have the form of boot 12, boot 32 or boot 52 and is preferably configured to have a width extending from the outer left side surfaces of the left set of legs 40, 42 to the outer right side surfaces of the right set of legs 40, 42. The boot 52A therefore extends from the right to left sides of the frame. As such, the single boot 52A will extend below all of the legs 40, 42, or under the left and rights sides of the furniture if there are no legs and only leg portions formed by the frame. The boot 52A may have a planar portion 54A which extends below all of the legs 40, 42, and which planar portion 54A may be angled as in boot 52.

Boot 52A also includes the planar portion(s) 36A at its rear that are used to attach the boot 52 to the furniture, e.g., the rear surfaces of the rear legs 40 or more generally the rear surfaces of the frame. There may be a single planar portion 36A that extends across the entire length of the boot 52, i.e., it would have the same width as the underlying planar portion 54A of the boot 52, or there may be two, spaced apart planar portions 36A that each only extend behind a respective one of the rear legs 40. These planar portions 36A may be rigid with the underlying planar portion 54A of the boot 52A as in boot 12, or pivotally attached thereto by hinges as in boot 32. In either situation, both rear legs 40 are attached to the same boot 52A.

The width of the boots 12, 32, 52 may also vary from that shown but be less than the full width of the furniture as in boot 52A shown in FIG. 11A. The width of the boots 12, 32, 52 may be 2 inches, 4 inches, 6 inches or 8 inches, for example, Other widths are also possible.

Referring now to FIGS. 11B-11F, another embodiment of a boot 52B in accordance with the invention includes several features that may be incorporated into any of the other boots disclosed herein, individually or in any combination. The first feature is a side rail 53 that extends upward from an outer side or outer edge 55 of the first planar, horizontal portion. As shown, the side rail 53 is positioned to be alongside both the rear leg 40 and the front leg 42, although it is possible to dimension it to be alongside only the rear leg 40 or only along the front leg 42.

Although shown in the drawings and described in connection with use of the boot 52B, it is possible that the boot 52B is used with a piece of furniture that does not have legs, but rather has a straight bottom.

If legs are provided on the dresser 8B, then the length of the side rail 53 may therefore be from an edge region of the rear leg 40 to a front region of the front leg 42, possibly to be flush with the rear surface of the rear leg 40 and flush with the front surface of the front leg 42. If used with a dresser without legs and only a straight bottom formed for example by a lower side panel that is flush to the floor or underlying support substrate, then the side rail 53 may have a length to be along only a portion of or along all of this straight panel.

Figure 11C:
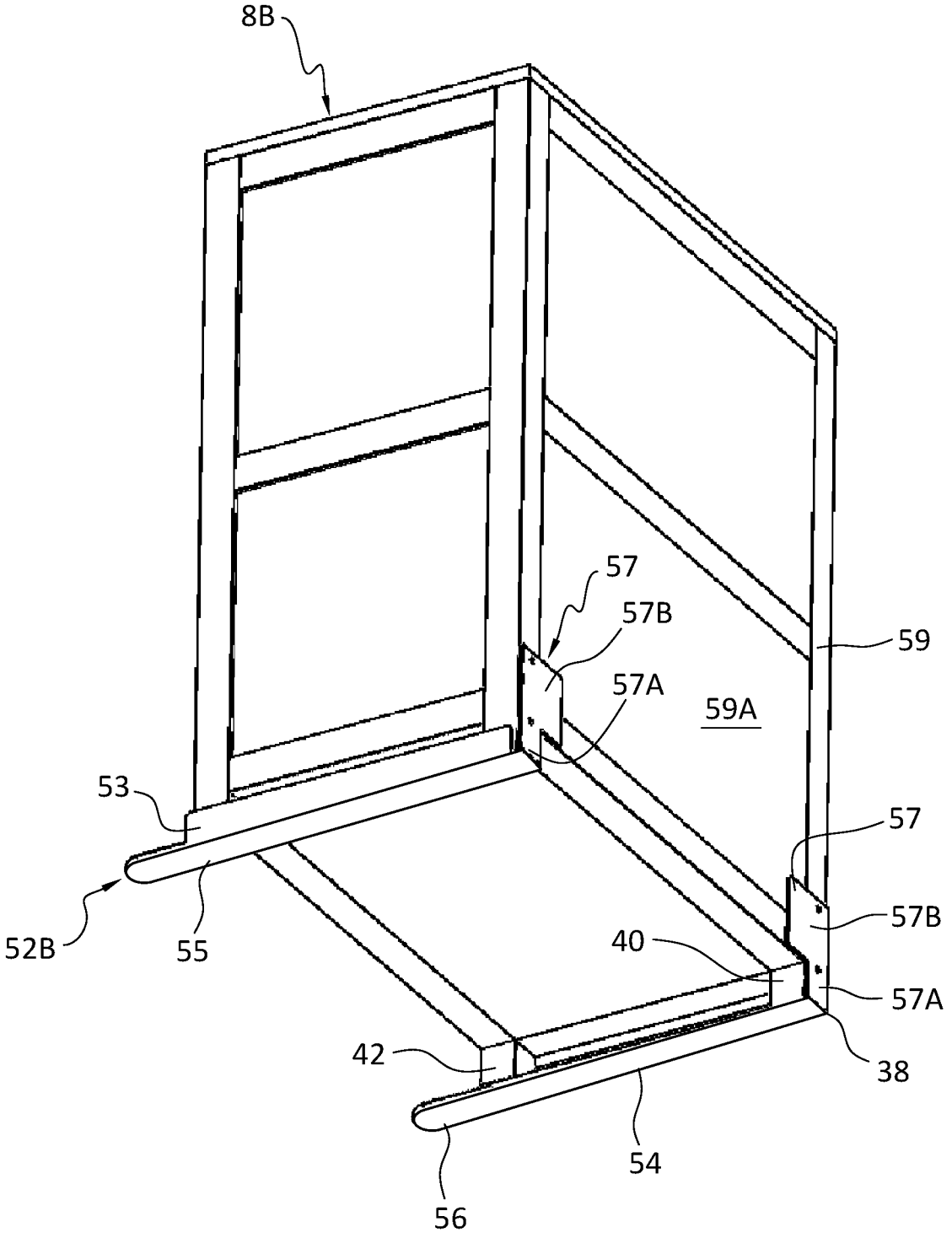
FIG. 11C is a rear, bottom perspective view of the dresser shown in FIG. 11B.
Figure 11D:
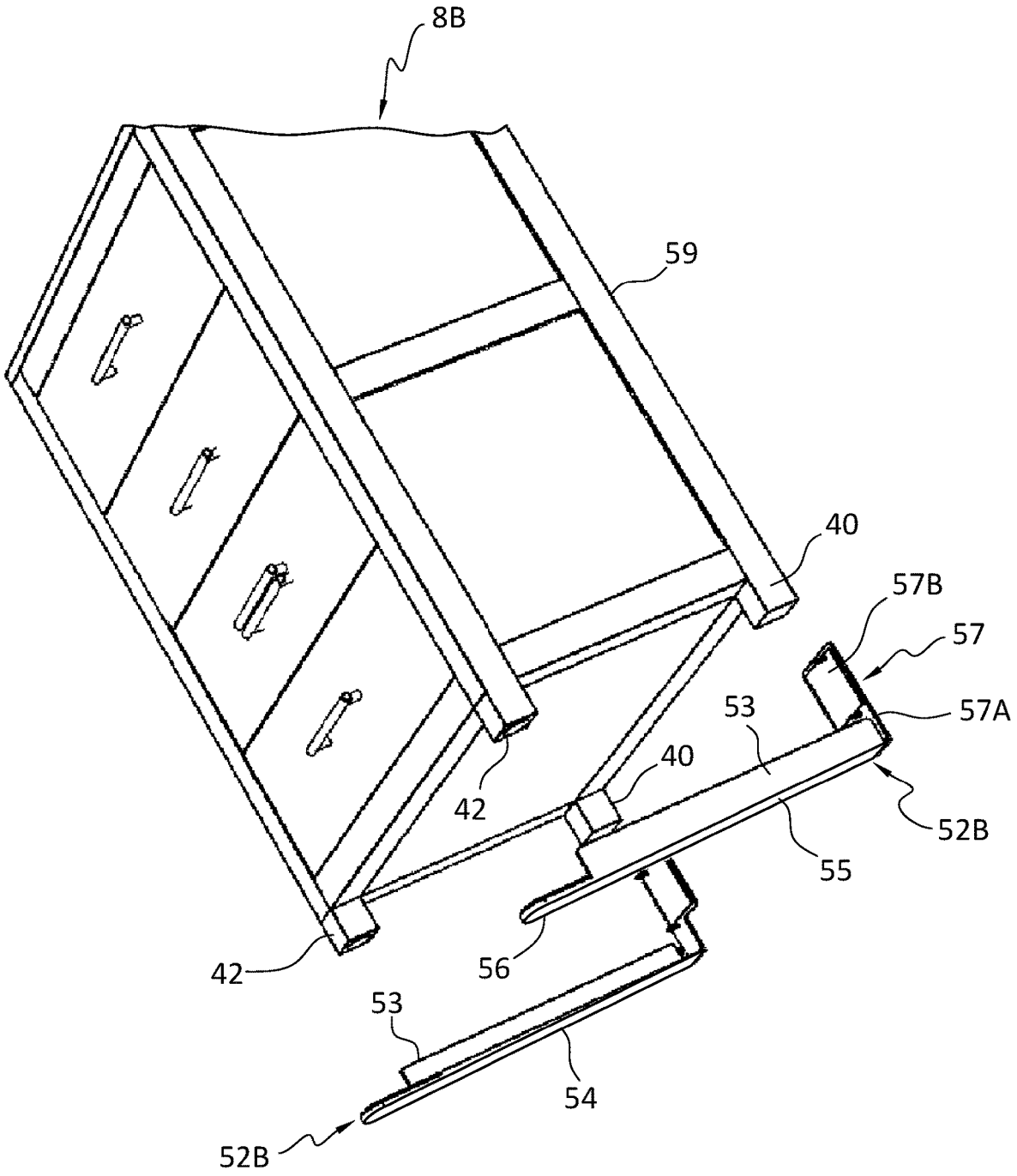
FIG. 11D is a rear, bottom perspective view of the dresser shown in FIG. 11B with the anti-tipping mechanism separated from the dresser.
Figure 11E:
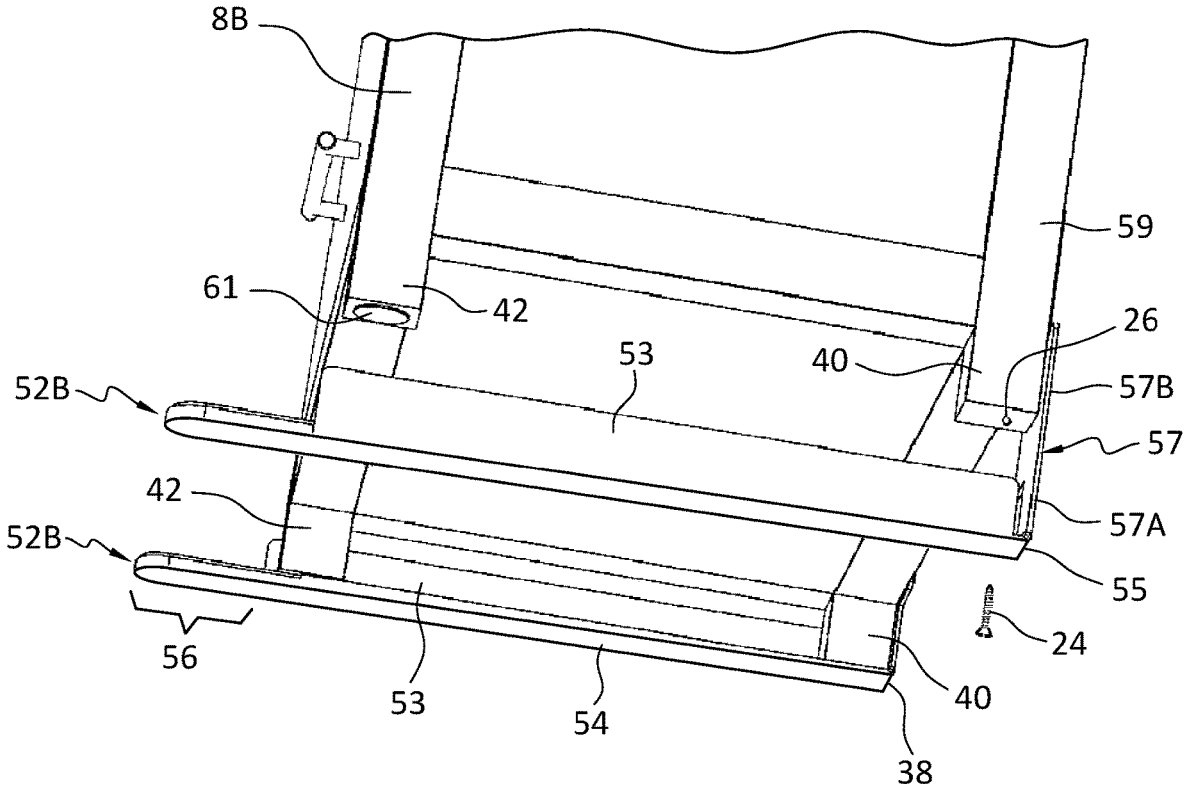
FIG. 11E is a view showing various attachments of the anti-tipping mechanism to the dresser of FIG. 11B.

Preferably, the side rail 53 is separated from the second planar portion (as shown in FIG. 11E) since the second planar portion is hingedly connected to the first planar portion. If the second planar portion is fixed to the first planar portion, then the side rail could also be fixed to the second planar portion. The presence of the hinge allows the full range of better engagement to the back of the dresser 8B, whereas a fixed right angle boot would be limited to use with a dresser wherein the base and back of the dresser are perfectly at a right angle.

The side rail 53 does not have to be in direct contact with the rear and/or front legs 40, 42 or lower side panel once installed, as there may be an intervening material, e.g., a cushioning material. However, the side rail 53 should be sufficiently rigid and fixed relative to the first planar portion to enable it to reduce and ideally prevent possible sideward movement of the dresser 8B. Side rail 53 may also be considered a side rib.

Advantages of the side rail 53 are to provide reinforcement for retention of the dresser 8B on the boot 52B, and aid in registration and placement of the dresser 8B on the boot 52B, noting that there would be one boot 52B on each side of the dresser 8B and the side rail 53 would be on the outer edge of each boot 52B (outer with respect to the dresser 8B). Thus, a dresser 8B with two boots 52B would not have identical boots 52B but rather, one boot 52B would have the side rail 53 on one side and the other boot 52B would have the side rail 53 on the other side (see FIGS. 11B, 11C and 11E). The installer of the boots 52B would obviously position the correct boot 52B on the appropriate side of the dresser 8B. The raised side rail 53 also aids in preventing someone from kicking the dresser 8B inward out of placement on the boot 52B. In addition to providing flush registration, it is also conceivable that the side rails 53 can adhere (e.g., using VELCRO®, double face tape or 3M Dual Lock) to the front or back of the dresser with or without legs.

Side rail 53 may be included as part of any of the other boots disclosed herein, whether a side rail alongside both front and rear legs or only one legs, or alongside a portion of or the entirety of a lower side panel. If configured to extend alongside both legs or the entirety of a lower side panel on one side of the dresser 8B, the side rail 53 does not have to extend continuously with the same height, but could have a variable height in its length between the front and rear of the dresser 8B. Moreover, instead of a single side rail 53, a side rail portion can be provided alongside each of the rear and front legs 40, 42, with the side rail portions being separate from one another, but connected through the intermediacy of the first planar portion. Also, instead of a single side rail 53, a side rail portion can be provided alongside each of rear and front portions of the lower side panel of a dresser with such a lower side panel, with the side rail portions being separate from one another, but connected through the intermediacy of the first planar portion.

Another feature of boot 52B is an enlarged second planar portion 57 that attaches to a larger area of the rear surface of the dresser 8B than just to a portion or all of the rear surface of the rear leg 40 (e.g., as in FIG. 1). The enlarged second planar portion 57, which may be in the form of a rigid plate, has a lower section 57A that is preferably dimensioned to correspond to the size of the rear surface of the rear leg 40 or rear lower panel if there is no rear leg, and an upper section 57B that is preferably dimensioned to fit alongside at least a portion of the rear surface 59A of the support structure 59 at the rear of the dresser 8B. The upper section 57B has a larger width than the lower section 57A. Exemplary dimensions are that the upper section 57B has a height of 4 inches and a width of 4 inches with the lower section 57A having a height of two inches and a width of 2 inches. As such, the total height of the enlarged second planar section 57 is 6 inches and its width increases from 2 inches at the bottom to 4 inches at the top. The enlarged second planar portion 57 may include or consist entirely of a square portion or a rectangular portion, with the preferred shape extending to be able to adhere to the back surface of the dresser with adhesive engagement. Using screws as the attachment means is not as secure as it is when a full adhesive is used or combined with adhesive and screws. The enlarged second planar portion 57 may be about 6 inches by 6 inches square.

In the illustrated embodiment, the upper section 57B is alongside a part of the upper rear frame support 59A and also alongside a part of the lower rear frame support 59B (see FIG. 11C). The enlarged second planar portion 57 increases stability of the attachment of the boot 52B to the dresser 8B and aids in preventing someone from kicking the dresser 8B outward out of placement on the boot 52B since the boot 52B is now also against the rear surface of the support structure 59 of the dresser 8B.

Attachment of the enlarged second planar portion 57 to the dresser 8B is by means disclosed herein, e.g., screws 24 passing through apertures 26 in the second planar portion 57 and then preferably into aligning apertures in the dresser 8B. Apertures 26 can be positioned in the second planar portion 57 so that the screws 24 will enter into the rear surface of the rear leg 40 and/or into the rear surface 59A of the support structure 59 (see FIG. 11C), or into the rear surface of the rear panel if no legs are provided. In one embodiment, at least one screw 24 would enter into the rear leg 40 and one into the support structure 59. In another embodiment, two or more screws would enter into the support structure 59. If screws 24 are used, it is also possible to form apertures in the first planar portion and optionally apertures in the bottom surfaces of the rear and front legs 40, 42 in alignment therewith to enable the first planar portion to be attached to the legs 40, 42 via the screws and apertures (see FIG. 11E wherein a single screw 24 is shown entering through the first planar portion into an aligning aperture in the rear leg 40).

As an alternative (or addition) to screws to attach the first planar portion and/or the second planar portion to the dresser 8B (or one of the legs thereof or lower and rear panels), it is possible to use double-sided tape or hook and loop fasteners, for example, professional grade adhesives such as 3M Double Face Tape, VELCRO® or Scotch 3M Dual Lock. Indeed, such materials can partly or entirely substitute for the screws. As shown in FIG. 11E, the front leg 42 includes a round portion of adhesive material 61. This front adhesive portion 61 prevents the extended front of the boot 52B from being kicked forward or rearward. Similar adhesive portions may be used on the bottom surface of the rear leg 40, the rear surface of the rear leg 40 and the rear surface of the support structure 59. Use of professional grade adhesive may result in an increase in the size of the second planar, vertical portion of the boot, but along with the possibly smaller adhesive portions on the bottom surfaces of the rear and front legs 40, 42 could provide a screw-less secure mounting of the boot 52B to the dresser 8B to thus resist dresser tipping.

Figure 11F:
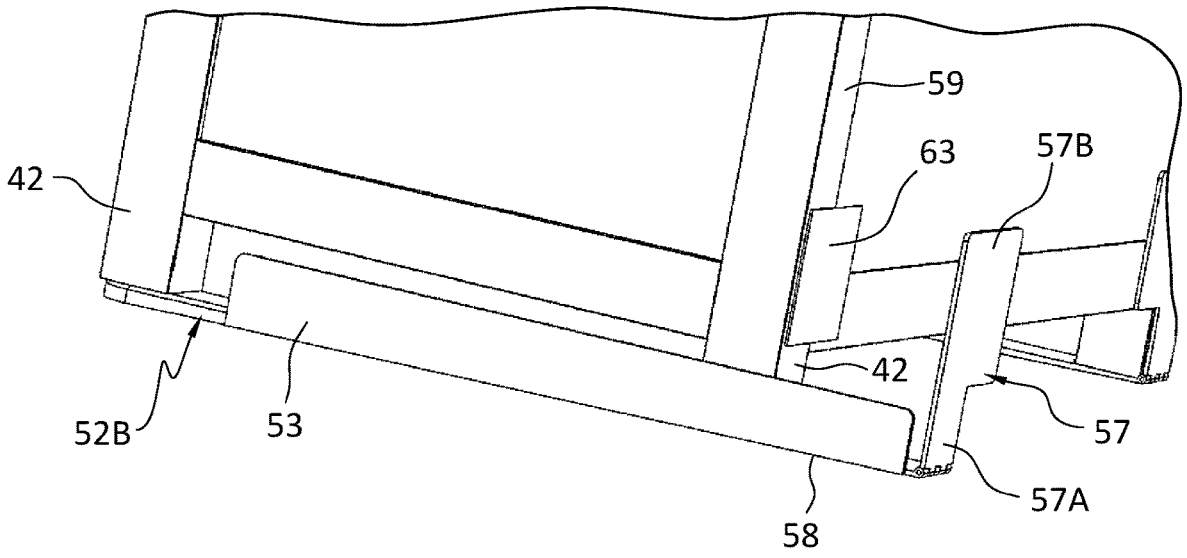
FIG. 11F is a view showing another attachment of the anti-tipping mechanism to the dresser of FIG. 11B than shown in FIG. 11E.

As shown in FIG. 11F, an adhesive portion 63 is affixed to the rear surface of the support structure 59. The rear of the dresser 8B may be Masonite and the adhesive can extend so that the support structure 59 can be the entire back. As such, the adhesive can be a 4" or 5" square and not just support what is the post, but rather could be substantially the same surface area of the upper section 57B or even both the lower section 57A and the upper section 57B). The size of the adhesive portion 63 does not matter as long as sufficient adhesion is provided thereby. Although the adhesive portion 63 may be provided with a size to roughly correspond to or be smaller than the size of the upper section 57B of the second planar portion 57, this is not required. One skilled in the art would be able to determine the size of the adhesive, which depends in part on the type of adhesive, to ensure suitable adhesion of the boot 52B to the dresser 8B, or any other dresser or piece of furniture.

Generally, when using adhesives instead of screws, it is often beneficial to increase the size of the adhesive area. One skilled in the art would readily ascertain how to configure the planar portions of the boot 52B relative to the size of the adhesive portions 61, 63 to provide for secure attachment of the dresser 8B to the boots 52B, which also depends on, for example, the size and shape of the dresser 8B.

The enlarged second planar portion 57 may be provided to any of the other boots disclosed herein, along with the use of adhesives instead of screws. Also, the features disclosed above with respect to boot 52B, wherein there is a hinge 38 between the first and second planar portions 34, 36 can be applied to the boot without such a hinge, i.e. wherein the second planar portion is fixed at an angle to first planar portion to enable it to attach to the rear surface of the rear leg or other rear surface of the piece of furniture.

Figure 12:
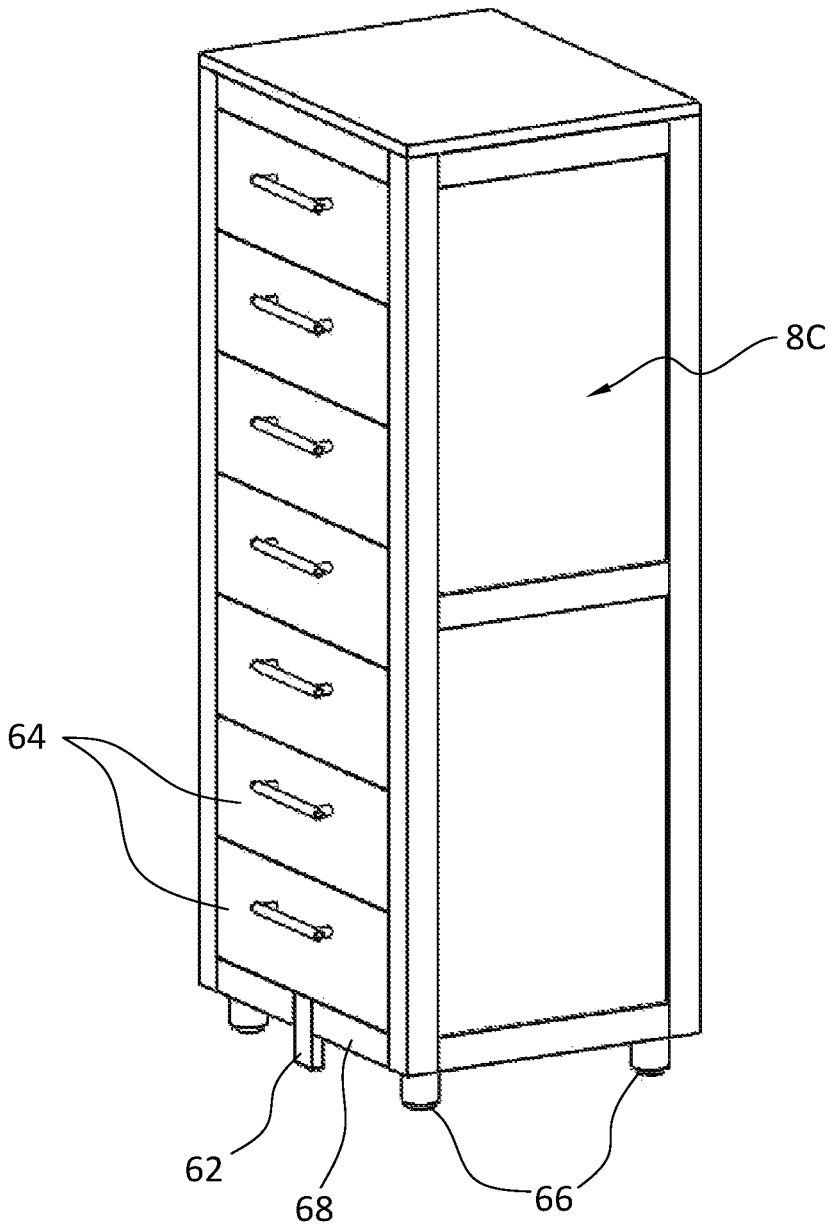
FIG. 12 is a front perspective view of a dresser including another embodiment of an anti-tipping mechanism in accordance with the invention.
Figure 13:
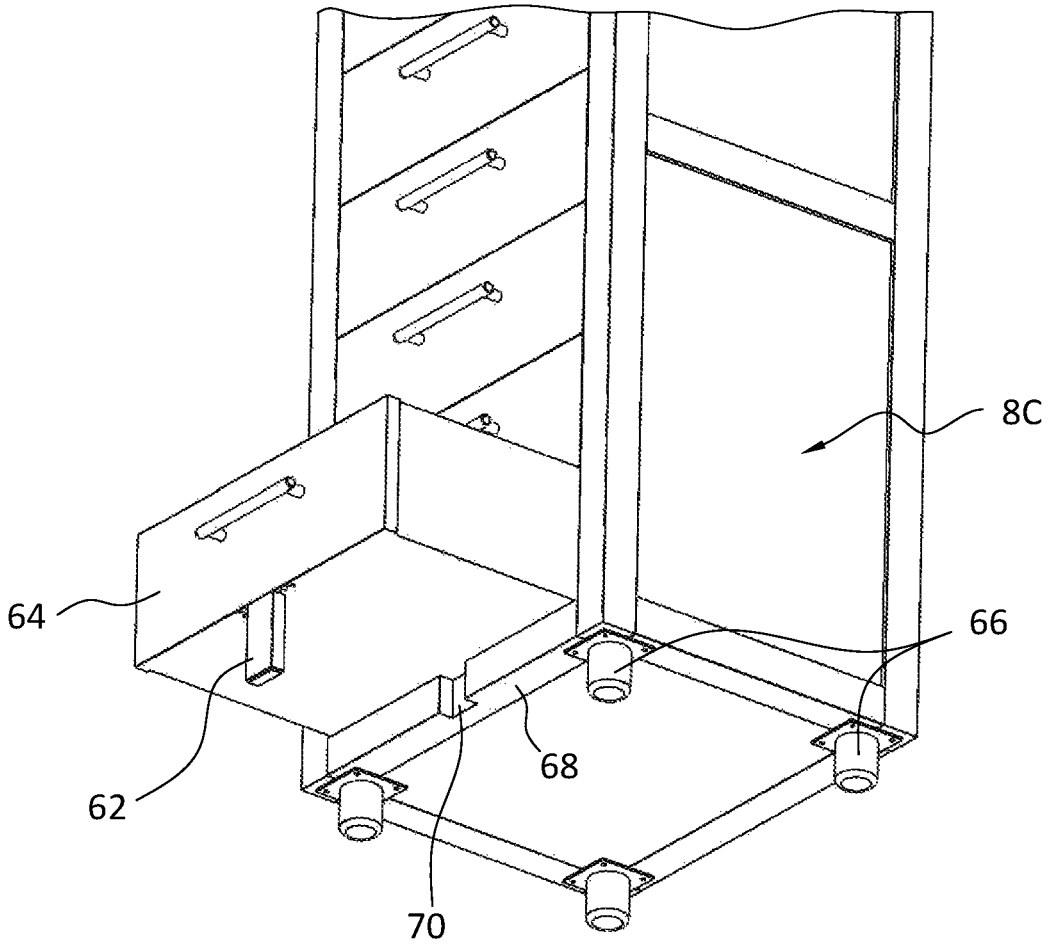
FIG. 13 is a bottom perspective view of the dresser shown in FIG. 12 with the bottom drawer in an open state.

FIGS. 12 and 13 show another embodiment of an anti-tipping mechanism in accordance with the invention which includes a fixed post 62 on the bottom drawer 64 of a dresser 8C. The fixed post 62 is rigid and is attached or integral with the bottom drawer 64 so as to provide a potential additional support point for the dresser 8C, along with support legs 66. Thus, the bottom surface of the fixed post 62 should be dimensioned to be close to the horizontal surface on which the dresser 8C is situated. Fixed post 62 serves to prevent forward tipping of the dresser 8C. The molding 68 on the dresser 8C ideally includes a cut-out 70 for the fixed post 62 (see FIG. 13).

As to this embodiment and other disclosed embodiments that have one or more fixed posts to the bottom drawer 64, this provides anti-tipping with the bottom drawer 64 when opened. Should a toddler climb into the bottom drawer 64, there would be resistance for the drawer 64 to fall forward. Each fixed post 62 is ideally at least about 0.25 inches to about 0.5 inches shorter than the height of the support legs 66 (which is more generally, the distance between the location on the front panel from which the post 62 descends and the bottom surface of the support structure whether the legs or other structure which is the bottom surface of the frame of the dresser 8C). As such, when the bottom drawer 64 is opened, the fixed posts 62 do not interfere with drawer functionality. Since the distance to the floor is only about 0.25 inches or 0.5 inches, should a toddler climb into the drawer 64, the dresser 8C will only slightly fall forward.

If the dresser 8C does not include legs 66, then it would include equivalent support structure, such as right and left side panels. Regardless of the type of support structure for the frame, i.e., either legs or side panels, the post 62 ideally has a height or major distance which is shorter than a distance between the bottom of the drawer and the bottom surface of the support structure of the frame of the dresser 8C (assuming the post begins at the bottom of the drawer).

Instead of a fixed post, a post could be pivotable between a position under the bottom drawer to an extended position.

Figure 14:
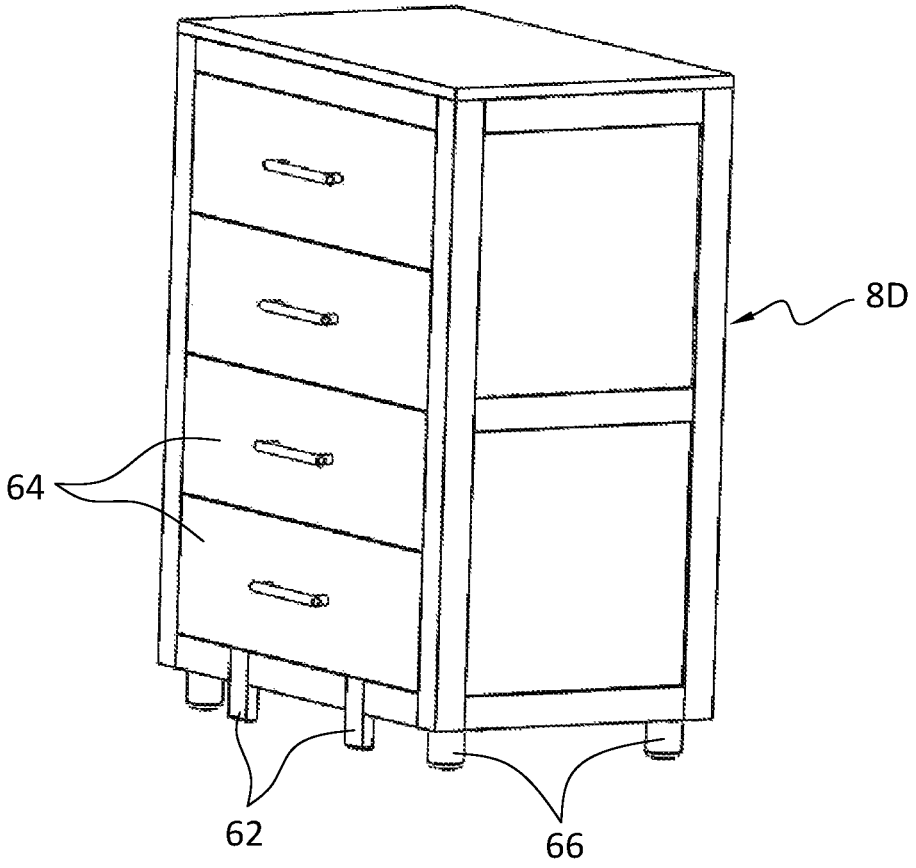
FIG. 14 is a front perspective view of a dresser including another embodiment of an anti-tipping mechanism in accordance with the invention.
Figure 15:
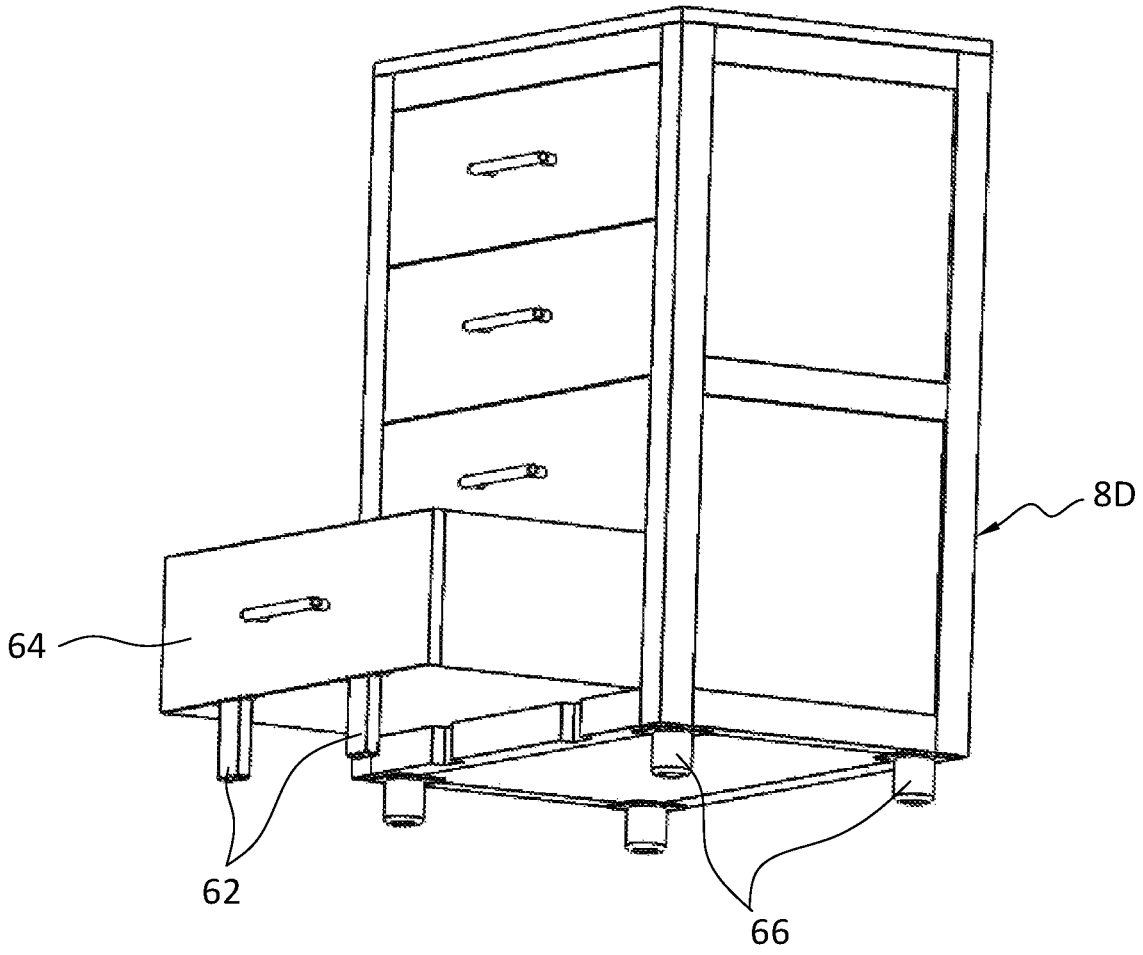
FIG. 15 is a front perspective view of the dresser shown in FIG. 14 with the bottom drawer in an open state.

While a single central fixed post as shown in FIGS. 12 and 13 will likely prevent an accident, an anti-tipping mechanism including two fixed posts 62 on the bottom drawer 64 of the dresser 8D will offer more positive floor surface engagement and resist cocking the dresser to pivot to one side, and is shown in the embodiment of in FIGS. 14 and 15. Ideally, the two posts 62 are placed a distance sufficiently apart from one another to provide stability as the drawer 64 tips about 0.25 inches forward and positively stops falling any further.

In many situations where the toddler is under 2 years old, it may very well be that he/she may not be able to reach any higher than the bottom drawer 64. If on the other hand, the toddler is 3, 4 or 5 years old, a superior choice may be to go with one of the boots disclosed herein. An embodiment of a dresser is also envisioned which includes both the boots as well as one or more fixed posts 62 for double anti-tipping insurance.

Figure 16:
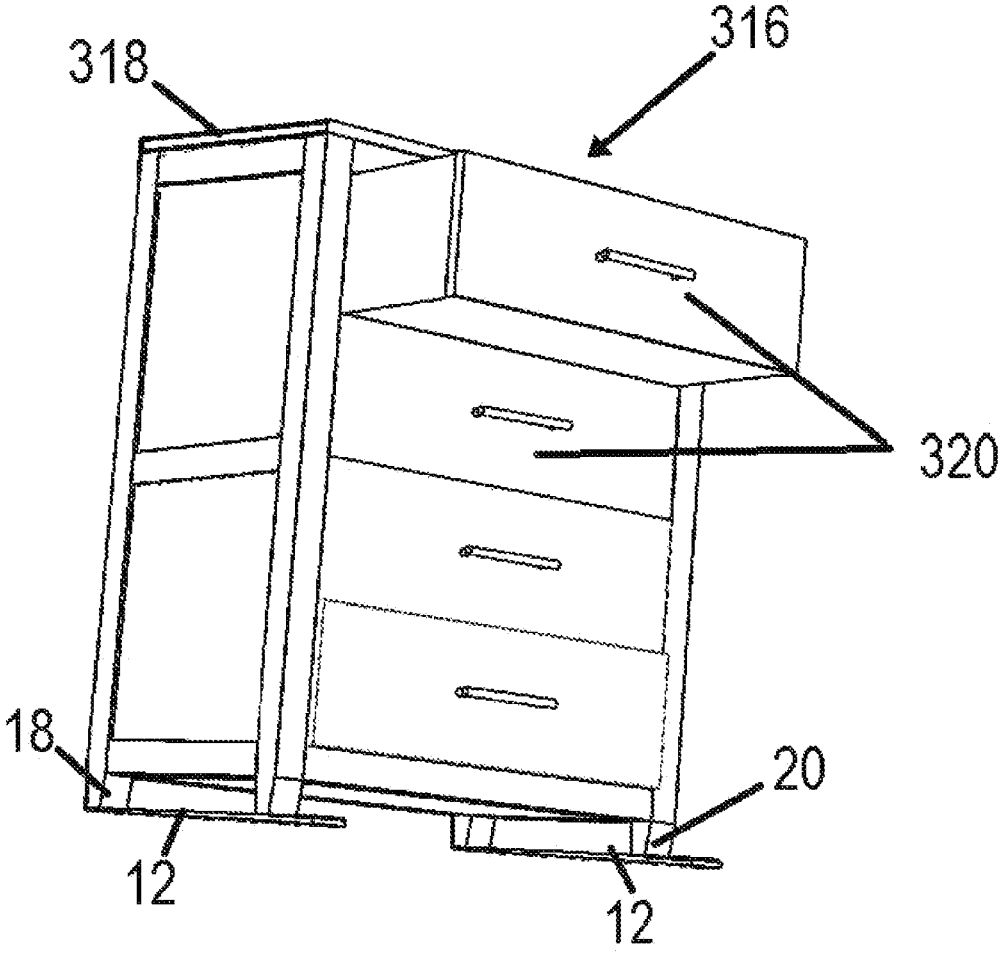
FIG. 16 is a front perspective view of another embodiment of a dresser providing anti-tipping properties in accordance with the invention.
Figure 17:
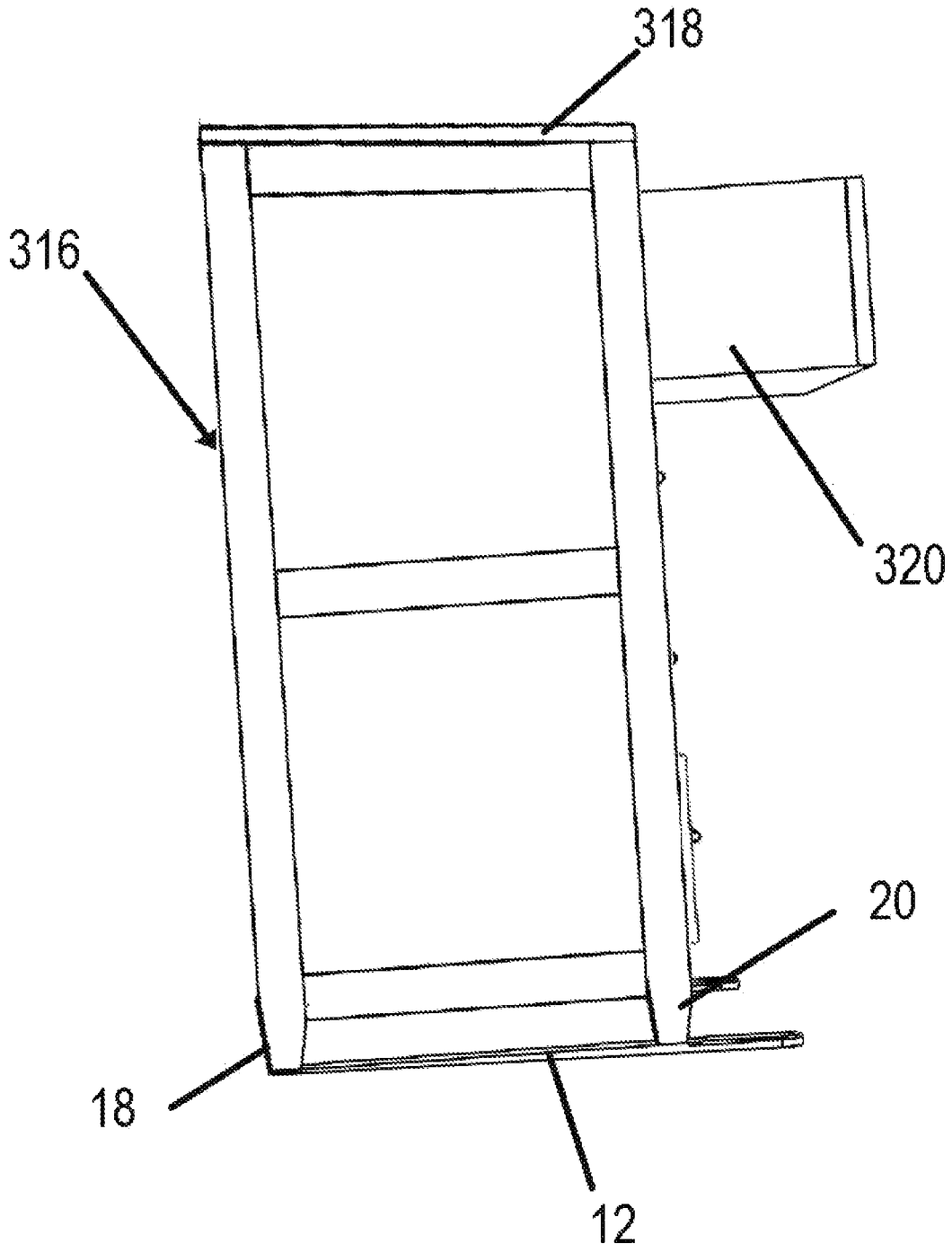
FIG. 17 is a side perspective view of the embodiment of the dresser providing anti-tipping properties in accordance with the invention shown in FIG. 16.
Figure 18:
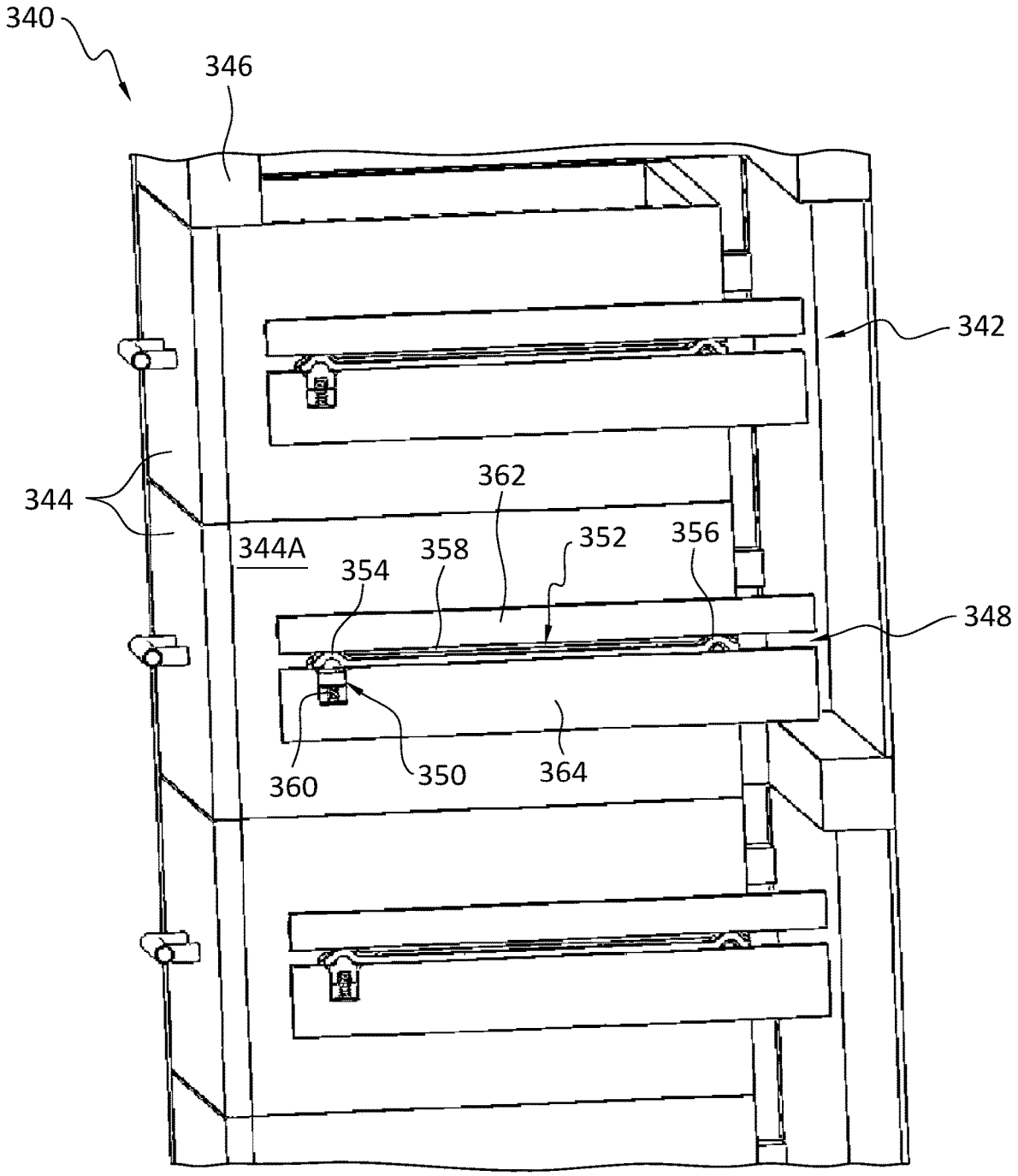
FIG. 18 is a side view of another embodiment of a dresser in accordance with the invention with the side of the frame removed.

Referring now to FIGS. 16 and 17, in this embodiment, a dresser 316 is modified for use with a boot as disclosed herein, e.g., boot 12 but all of the boots and other similar structures disclosed herein can be used with this dresser 316. The dresser 316 is provided with an upper panel or board 318 that provides the uppermost, exposed surface of the dresser 316. The board 318 is not parallel to the horizontal surface on which the dresser 316 is situated when the boot 12 is not present. Rather, the board 318 is angled such that it slopes downward in a direction from the back to the front of the dresser 316. That is, when the dresser 316 is installed such that its lowermost surface, e.g., the lower surface of the legs 18, 20, is in contact with the horizontal support surface, the top front of the dresser 316 is lower than the top, rear of the dresser 316. This angle may be as small as 0.5 degrees to a few degrees, e.g., about 5 degrees.

However, the angular configuration of the board 318 is such that when the boot 12 is underneath the dresser 316 as shown, the board 318 is parallel to the horizontal surface on which the dresser 316 is situated. Thus, the dresser 316 presents a level surface when the boot 12 is in place, a level surface being a surface parallel to the horizontal surface that supports the dresser 316. The angled pitched top of the dresser 316 is thus brought into a parallel relationship with the horizontal surface that supports the dresser 316, its slant being compensated for by the presence of the boot 12. The angle of the boot 12 is therefore preferably the same angle as the upper board 318.

Also, the drawers 320 will not open and close in directions parallel to the horizontal surface that supports the dresser 316. Rather, the drawers 320 will be slightly angled upward at their front (with the same angular orientation as the boot 12 and upper board 318), when the boot 12 is in place. This further provides tipping resistance.

Figure 19:
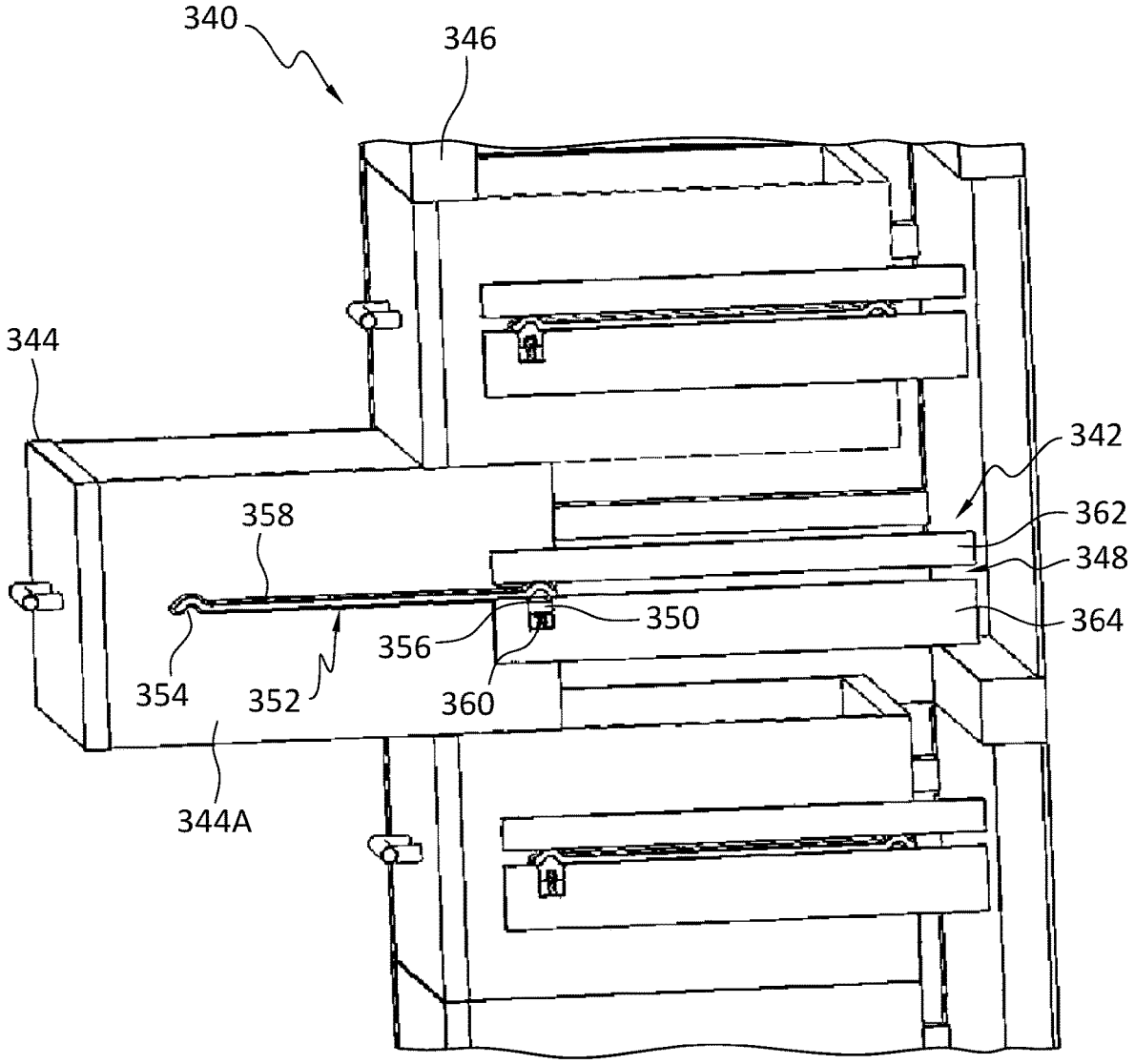
FIG. 19 is a view showing the dresser of FIG. 18 with the drawer in an open state.
Figure 20:
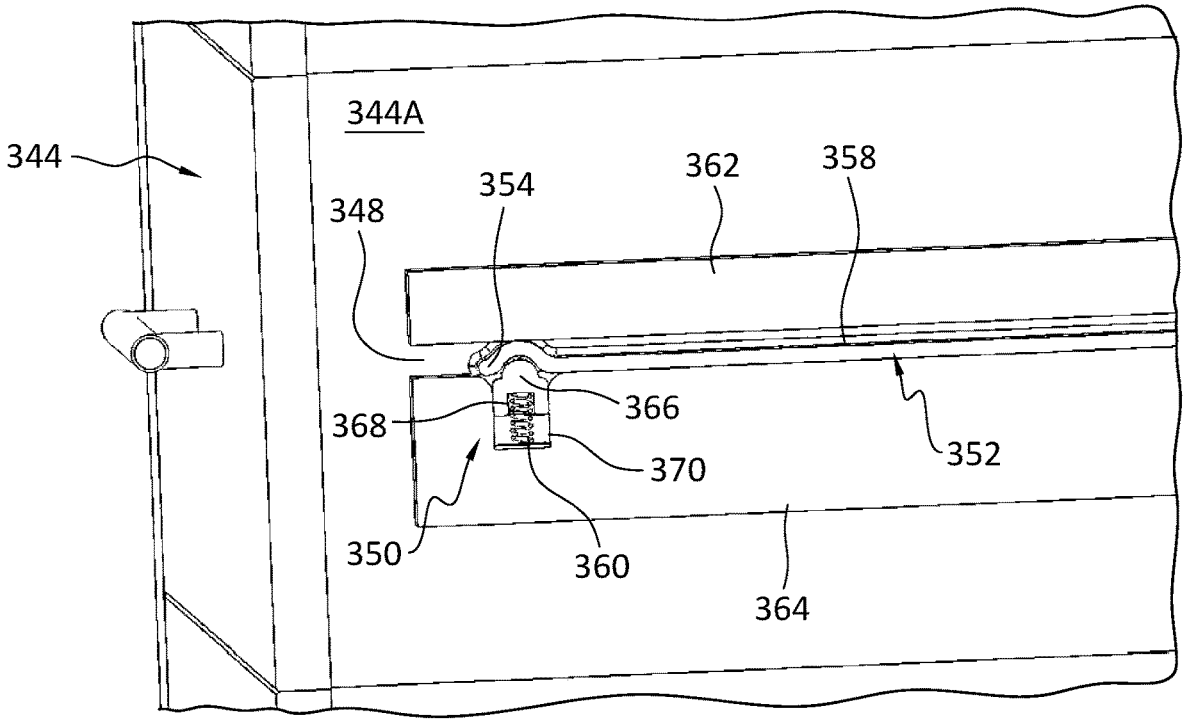
FIG. 20 is an enlarged view of the drawer of the dresser shown in FIG. 18 in a closed state.

Referring to FIGS. 18-22, another embodiment of a multi-drawer dresser 340 in accordance with the invention includes a drawer retention mechanism 342 that provides secure retention of a respective drawer 344 both when in a closed state (FIG. 18) and in an access state partly out of a frame 346 of the dresser 340 (FIG. 19). In the latter state, the drawer 344 is prevented from moving further forward and possibly causing tipping of the dresser 340 when grasped by a child or toddler. There is a drawer retention mechanism 342 on each side of each drawer 344.

Each drawer retention mechanism 342 includes an elongate track 348 into which a spring-loaded plunger 350 projects and a cooperating elongate rail 352 attached to a side wall 344A of the drawer 344 and that is movable through and in a longitudinal direction of the track 348. The rail 352 includes a pair of concave wells 354, 356, one at each end region of the rail 352, and into which the plunger 350 projects depending on the position of the rail 352 relative to the plunger 350. Between the wells 354, 356, the rail 352 has a straight, elongate portion 358. As shown, the wells 354, 356 open downward while the plunger 350 is configured to spring upward when not pressed downward (the reverse configuration is also a possibility). The plunger 350 thus has a compressed state in which it is maintained below the track 348 by the elongate portion 358 of the rail 352, and a spring 360 therein is compressed, and an extended state in which it projects into one of the wells 354, 356, and the spring 360 therein is expanded. When in the extended state projecting into the front or rear well 354, 356, the spring 360 generates a temporary stop to the movement of the drawer 344.

The rear well 356 is optional and indeed, a drawer retention mechanism 342 may be provided without the rear well 356 and be functional to achieve the object of drawer retention sought by the mechanism. The optional rear well 356 engages with the plunger 350 to establish the maximum pulled-out safe position of the drawer 344, but other means to achieve this pull-out limit may be provided in the invention, including those known to people skilled in the art to which this invention pertains.

Each track 348 may be defined between an upper part 362 of the frame 346 having a planar lower surface and a lower part 364 of the frame 346 having a planar upper surface, which parts 362, 364 may be integral with the frame 346 of the dresser 340 or separate members that are attached thereto. These parts 362, 364 may be made of any suitable material, e.g., wood or metal, and define the generally horizontal track 348 since it is desired that the drawer 344 open horizontally. The plunger 350 is situated in a front region of the lower part 364. Its position is coordinated to the dimensions of the drawer 344 and dresser 340 in general so that the drawer 344 is in its fully closed state when the plunger 350 enters into the front well 354. The parts 362, 364 may even be formed from a single member.

Each of the wells 354, 356 preferably has soft lead-in and lead-out easements, especially at the rear of the front well 354 and the front of the rear well 356 since the upper surface of the plunger 350 will move over these parts when moving into the elongate portion 358 of the rail 352. In one embodiment, an additional plunger is provided at the rear of the track 348 to aid in retention of the drawer 344 and in this case, the easement at the rear of the rear well 356 should also be soft.

Figure 22:
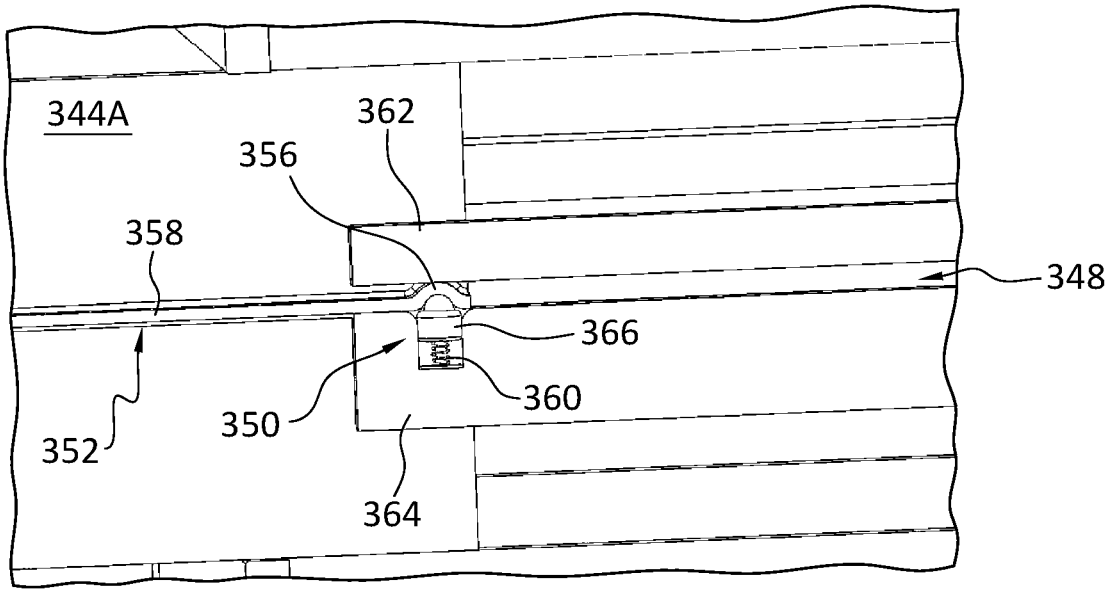
FIG. 22 is a view showing the drawer of the dresser shown in FIG. 18 in a maximally safe open state.

Plunger 350 has a curved plunging portion 366 at its top and the spring 360 enters into a cavity 368 in the portion 366 with the other end of the spring 360 preferably being fixed at the bottom of a well 370 in the lower part 364 (FIG. 22).

Figure 21:
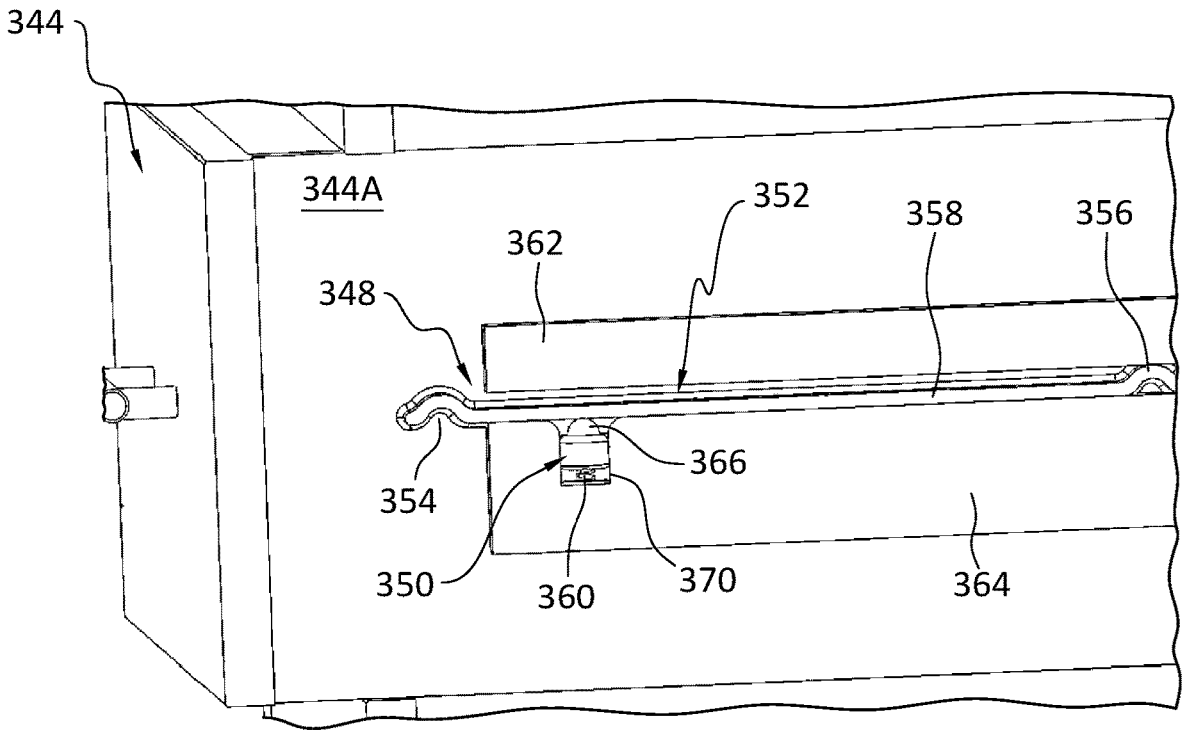
FIG. 21 is an enlarged view showing the drawer of the dresser shown in FIG. 18 in a state during opening or closing movement.

The plunging portion 366 may be hemispherically shaped. In the compressed state, the upper surface of the plunging portion 366 may be flush with the upper surface of the lower part 364 defining the track 348 (FIG. 21). As such, the elongate portion 358 of the rail 352, which preferably has a flat, planar lower surface, slides easily over the plunging portion 366.

The depth of the front well 354 can be deeper than the depth of the rear well 356 to allow the spring-loaded plunger 350 to form a more forceful safety stop when the drawer 344 is closed. An advantage of this is that in the event the dresser 340 is tipped forward by a toddler, the drawer 344 would resist moving forward to cause injury by hitting the toddler in the face or head. When the drawer 344 is in a partly open state, the plunger 350 will slide along the straight portion 358 of the rail 352 during continued forward movement of the drawer 344 until a maximum safe open state of the drawer 344 is reached in which the plunger 350 projects into the rear well 356, and thereby the drawer 344 is prevented from moving fully outward and apart from the dresser 340.

In use, when a person wants to open the drawer 344 of the dresser 340, the person must exert a force to overcome the spring force or resistance that is urging the plunger 350 into the front well 354. This force should be greater than the force that a toddler can exert to thereby prevent the toddler from opening the drawer 344, and possibly even a child 3-5 years old. Determination of the magnitude of this force is possible based on the characteristics of the spring force provided by the spring 360 and the easements at the edges of the well 354. Once the plunger 350 is urged downward into the well 370 of the lower part 364 defining the track 348, it remains there by pressure provided by the elongate portion 358 of the rail 352.

In this embodiment, the rail 352 includes the wells 354, 356 and the plunger 350 is incorporated into the lower part 364 defining the track 348. The reverse configuration is also possible, i.e., constructing the rail 352 to include the plunger 350 (which would be at a rear of the rail) and two wells in the upper or lower part 362, 364 defining the track 348 (one at each of forward and rear end regions). In such an embodiment, the plunger would move upon movement of the drawer while the wells would remain stationary (instead of the wells moving and the plunger staying stationary as in the illustrated embodiment).

Furthermore, although in dresser 340, the side rail 352 is attached to the side wall 344A of the drawer 344 and the plunger 350 is mounted in the lower track 364 attached to or part of the frame 346 of the dresser 340, these components can be reversed. That is, it is possible to attach the rail 352 to the frame 346 of the dresser 340 and the upper and lower parts 362, 364 and plunger 350 incorporated into the drawer 344.

Figure 23:
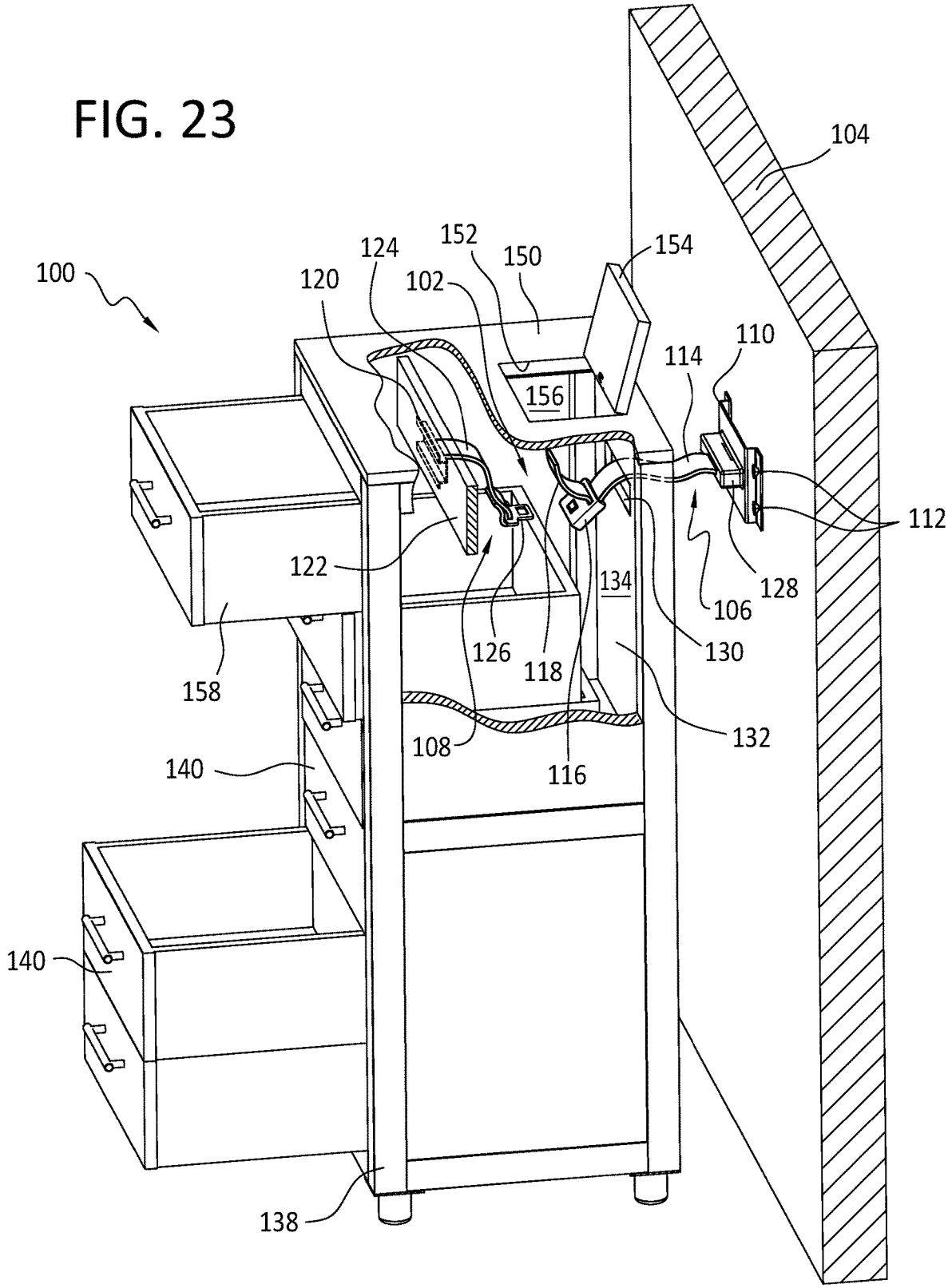
FIG. 23 is a perspective view, partly broken away, of another embodiment of a dresser in accordance with the invention.
Figure 24:
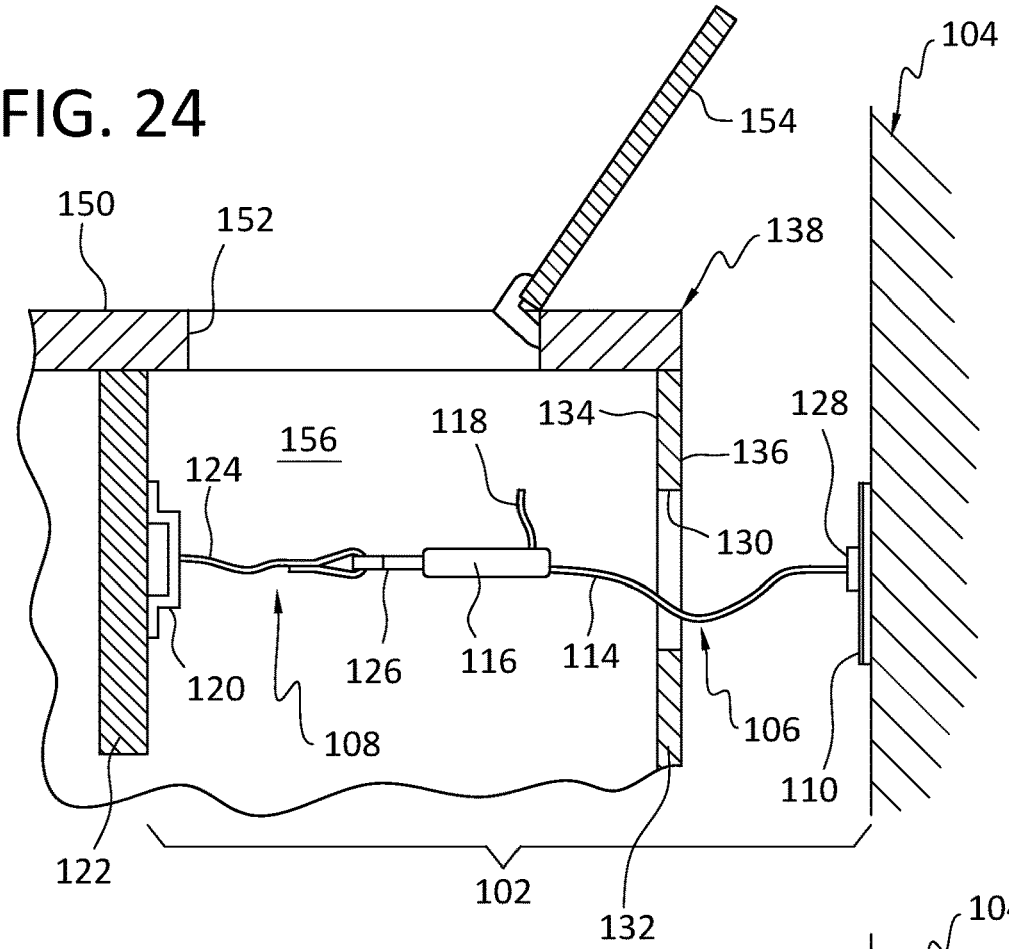
FIG. 24 is a view of the anti-tipping mechanism of the dresser shown in FIG. 23 in an intermediate state before final securing of the dresser to a wall.
Figure 25:
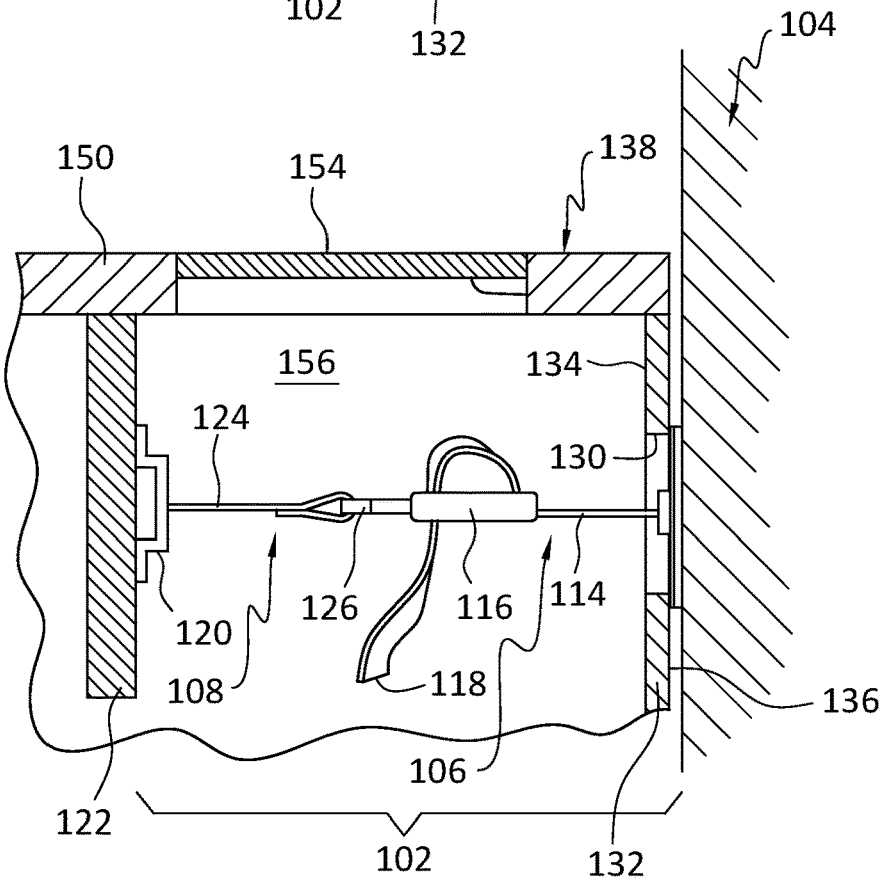
FIG. 25 is a view of the anti-tipping mechanism of the dresser shown in FIG. 23 in a final state in which the dresser is secured to the wall.

Referring now to FIGS. 23-25, in this embodiment of a dresser 100, there is a securing, anti-tipping mechanism 102 that functions to prevent tipping of the dresser 100 by securing the dresser 100 to a fixed structure behind the dresser 100, typically a vertical wall 104 but any other fixed structure may be used in the invention. Features of the dresser 100 are similar to those of the dressers 144, 180, 204 in the '397 application referenced above and incorporated by reference herein (FIGS. 23-34 thereof). Only important differences will be mentioned. Dresser 100 and its anti-tipping mechanism 102 constitute a furniture assembly.

In the furniture assembly including dresser 100, the anti-tipping mechanism 102 includes a first connector assembly 106 attached to the wall 104 and a second, mating connector assembly 108 attached to the dresser 100. The first connector assembly 106 includes a bracket 110 fixed to the wall 104 by, for example screws 112, and a strap 114 extending from the bracket 110, and which is connected at one end region to the bracket 110. An opposite end region of the strap 114 is passed through a buckle 116 to provide the strap 114 with a free end 118. A strap retainer 128 is shown to connect the end region of the strap 114 to a front surface of the bracket 110, but this strap retainer 128 is not required and the end region of the strap 114 can be connected directly to the bracket 110, e.g., by looping through slots of a planar portion of the bracket 110. The distance of the buckle 116 from the bracket 110 is adjusted by pulling the free end of the strap 114, this would shorten the distance between the buckle 116 and the bracket 110 (and thus the wall 104), and the buckle 116 can be pulled in a direction away from the bracket 110 to lengthen the distance between the buckle 116 and the bracket 110 (the wall 104). The combination of the strap 114 and buckle 116 is considered a connector. This connector is thus considered length-adjustable.

The second connector assembly 108 includes a bracket 120 fixed to a panel 122 of the dresser 100 by, for example screws, and a strap 124 extending from the bracket 120, and which is connected at one end region to the bracket 120. An opposite end region of the strap 124 is terminated by a catch 126, e.g., a planar piece of material that is configured to engage with the buckle 116 to provide a secure connection between the catch 126 and the buckle 116. It is possible to avoid use of the bracket 120 and attach the strap 124 directly to the panel 122 of the dresser 100, e.g., looping the strap 124 through slots in the panel 122 of the dresser 100. The combination of the strap 124 and the catch 126 is considered a connector.

The buckle 116 and mating catch 126 are an example of any type of mating, two-part connection structure that may be used in the invention. Any other known connection structure which has one part that removably engages with another part, and preferably can be disengaged from that part, may be used in the invention. Also, although both connector assemblies are shown including straps, which are flexible, it is possible to attach one or both of the buckle 116 and catch 126 directly to the bracket 110 or panel 122 of the dresser 100, respectively, via a rigid or length-invariable connection. If one of the mating connection structure is fixed to the bracket 110, and thus at a fixed distance from the bracket 110, then the other mating connection structure is manipulated, since it is flexible by virtue of the presence of the strap 124, to mate with it. Similarly, if one of the mating connection structure is fixed to the panel 122, and thus at a fixed distance from the panel 122, then the other mating connection structure is manipulated, since it is flexible by virtue of the presence of the strap 114, to mate with it. Although two fixed-distance (length-invariable) mating connection structures may be provided, this is not preferred since it is desired to have some flexibility and length adjustability in the attachment technique for the dresser 100.

To enable access to the buckle 116 and catch 126 to mate them or disengage them as desired, an upper panel 150 of the dresser 100 is provided with an opening 152 into which an access door 154 fits. Panel 150 is above panel 122 as shown. Access door 154 is pivotally connected to the upper panel 150 by a hinge to enable opening and closing of the access door 154 in order to access the space 156 underneath the upper panel 150 (see FIGS. 24 and 25). When the access door 154 is in the closed state, it may be flush with the remaining portion of the upper surface of the upper panel 150. The access door 154 thus pivots between a position out of the opening 152 (FIG. 24) and a position in the opening (FIG. 25).

This space 156 is formed by appropriately dimensioning the depth of an upper drawer 158 of the dresser 100, e.g., to be slightly less than the depth of the lower drawers in the dresser 100 (see FIG. 23). This lesser drawer depth enables the anti-tipping mechanism 102 to avoid interfering with drawer operation. If multiple drawers are provided at the top of the dresser 100, then only those drawers that will be in front of the anti-tipping mechanism 102 may be made with the lesser depth. Upper drawer 158 is that drawer that is immediately below the upper panel 150, and has a depth such that when present fully inside the dresser 100 and almost entirely below the upper panel 150, the space 156 is behind and not obstructed by the upper drawer 158.

A utility tray (not shown) may be provided to insert into the space 156 and obstructs viewing of the space 156 when the access door 154 is open. The utility tray optionally has a depth that is dimensioned to avoid interfering with the upper drawer 158 and rests on one or more flanges formed on surfaces defining the opening 152.

Instead of a pivoting access door 154, it is also possible to provide a sliding access door. The sliding access door would be provided by mounting sliding tracks on the dresser 100 and the access door 152. One skilled in the art would readily ascertain how to install such sliding doors in view of the disclosure herein.

In an exemplifying use, installation of the dresser 100 into a secure state with anti-tipping characteristics entails manipulating the anti-tipping mechanism 102 by first placing the dresser 100 against the wall 104, opening the access door 154, removing the utility tray if present and then grasping and pulling the buckle 116 through an aperture 130 in a substantially planar wall section or vertical rear panel 132 of the dresser 100 (assuming the bracket 110 is already attached to the wall 104 via bracket 110). The catch 126 is then inserted into or otherwise engaged with the buckle 116 to provide the state shown in FIG. 24. The dresser 100 is then positioned against the wall 104 with the bracket 110 either being partly against the rear panel 132 (as shown) or entirely within the aperture 130 in the rear panel 132. The free end of the strap 114 is then grasped and pulled to tighten the strap 114 by reducing the slack in the strap 114 until the straps 114, 124 are both tight and the dresser 100 is against the wall 104 to the extent possible (see FIG. 25). The free end of the strap 114 hangs down as shown in FIG. 25. The access door 154 is then closed and the dresser 100 is in a secure, anti-tipping state.

Moving the dresser 100 requires opening the access door 154 and lifting the buckle 116 to enable disengagement of the catch 126 therefrom, or otherwise manually disengaging the buckle 116 from the catch 126 or vice versa. The buckle 116 is passed through the aperture 130 and the dresser 100 can be freely moved away from the wall 104. The bracket 110 is removed from the wall 104.

Another way to view the invention is as a piece of furniture, not necessarily as a dresser, which includes a frame 138 including the substantially planar wall section 132 having front and rear surfaces 134, 136 defining a thickness therebetween and which forms at least part of a rear wall of the piece of furniture 100. The frame 138 also includes the upper panel 150 that defines the opening 152 and the access door 154 that controls access to the opening 152 in the upper panel 150 to enable selective access to the space 156 under the upper panel 150. The piece of furniture also includes the bracket 110 attachable to a vertical support (wall 104), a first connector (combined 114, 116) attached to the bracket 110, with the aperture 130 in the wall section 132 being dimensioned to enable passage of the first connector therethrough into the space 156 under the upper panel 150. A second connector (124, 126) is attached to the frame 138 in a position to be in the space 156 below the upper panel 150 and that removably engages with the first connector (catch 126 engages with buckle 116) when present in the space 156 under the upper panel 150. The first and/or second connector is length-adjustable relative to its supporting structure, i.e., relative to the bracket 110 in the case of the first connector 114, 116 or relative to the frame 138 in the case of the second connector 124, 126 to enable a distance between the frame 138 and the vertical support to be reduced. A reduction in distance between the frame 138 and the bracket 110, when connected to the vertical support 104, and engagement between the first and second connectors (catch 126 in buckle 116) prevents tipping of the piece of furniture.

In a preferred embodiment as shown, the first connector includes elongate strap 114 connected at one end region to the bracket 110 and the buckle 116 through which the strap 114 passes. The buckle 116 is movable along the strap 114 to vary a distance between the buckle 116 and the bracket 110 and thereby provide length adjustability to the first connector. Pulling a free end of the strap 114 relative to the buckle 116 causes a distance of the strap 114 between the buckle 116 and the bracket 110 to be reduced and by pulling the buckle 116 relative to the bracket 110 in a direction away from the bracket 110, a distance of the strap 114 between the buckle 116 and the bracket 110 is increased. The ability to increase the distance of the strap 114 between the buckle 116 and the bracket 110 by pulling the buckle 116 relative to the bracket 110 in the direction away from the bracket 110 is not a required feature of the invention, but is useful if repositioning or moving of the dresser 100 is desired.

Also, the second connector includes the elongate strap 124 connected at one end region to the frame 138, namely to the bracket 120 which in turn is fixed to the panel 122 which is part of the frame 138, and the catch 126 connected to a second end region of the strap 124 opposite the first end region of the strap 124.

The dresser 100 may include one or more additional drawers 140 below the upper drawer 158 and that each could have a larger depth than the depth of the upper drawer 158. Each additional drawer 140, like the upper drawer 158, has a first position fully inserted into the frame 138 (and possibly in the frame 138) and a second position at least partly out of the frame 138 and is movable outward from a front of the frame 138 into the second position while coupled to the frame 138. Each drawer 158, 140 has a front face forming a front face of the dresser 100.

It is possible, and considered as part of the invention, that the dresser 100 does not include any drawers, but may be configured as a different piece of furniture, e.g., with swinging doors opening to shelves. In this case, a space would be formed at the upper rear region of the piece of furniture to define the space 156 and the remaining features of the dresser 100 would be provided, except for an upper drawer 158.

While these embodiments are directed to the serious, often fatal, accidents involving toddlers, they address all anti-tipping furniture issues that may arise, involving both toddlers and adults.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A furniture assembly, comprising:

a frame comprising a rear wall of a piece of furniture, an upper panel that defines an opening and an access door that controls access through said opening in said upper panel to a space under said upper panel in front of said rear wall;

a bracket configured for attachment to a vertical support;

a first connector attached to said bracket, said rear wall including an aperture dimensioned to enable passage of at least part of said first connector therethrough from an area rearward of said rear wall into said space under said upper panel; and a second connector attached to said frame in a position to be in said space under said upper panel and that removably engages with said first connector when both are present in said space under said upper panel, said first or second connector being length-adjustable relative to said bracket or said frame respectively to enable a distance between said frame and said bracket to be reduced, whereby a reduction in distance between said frame and said bracket, when said bracket is attached to the vertical support, and engagement between said first and second connectors prevents tipping of the piece of furniture.

2. The furniture assembly of claim 1, wherein said first connector comprises an elongate strap connected at one end region to said bracket and a buckle through which said first strap passes, said buckle being movable along said strap to vary a distance between said buckle and said bracket and thereby provide length adjustability to said first connector, whereby by pulling a free end of said strap relative to said buckle, a distance of said strap between said buckle and said bracket is reduced.

3. The furniture assembly of claim 2, wherein said second connector comprises an elongate strap connected at a first end region to said frame and a catch connected to a second end region of said strap of said second connector opposite said first end region of said strap of said second connector, said catch releasably engaging with said buckle.

4. The furniture assembly of claim 3, further comprising an additional bracket fixed to said frame, said first end region of said strap of said second connector being connected to said additional bracket.

5. The furniture assembly of claim 1, wherein said second connector comprises an elongate strap connected at a first end region to said frame and a catch connected to a second end region of said strap opposite said first end region of said strap.

6. The furniture assembly of claim 5, further comprising an additional bracket fixed to said frame, said first end region of said strap being connected to said additional bracket.

7. The furniture assembly of claim 1, wherein said first connector comprises a first elongate strap connected at one end region to said bracket and a buckle through which said first strap passes, said buckle being movable along said first strap to vary a distance between said buckle and said bracket and thereby provide length adjustability to said first connector, whereby by pulling a free end of said first strap relative to said buckle, a distance of said first strap between said buckle and said bracket is reduced; and said second connector comprises a second elongate strap connected at a first end region to said frame and a catch connected to a second end region of said second strap opposite said first end region of said second strap, said catch being insertable into and removable from engagement with said buckle.

8. The furniture assembly of claim 1, wherein said access door is pivotally connected to said upper panel and pivots between a position in said opening and a position out of said opening.

9. The furniture assembly of claim 1, further comprising an upper drawer immediately under said upper panel and movable into and at least partly out of said frame, said upper drawer having a depth such that when fully present in said frame, said space is behind said upper drawer and not obstructed by said upper drawer.

10. The furniture assembly of claim 9, further comprising at least one additional drawer below said upper drawer that has a larger depth than said upper drawer, said at least one additional drawer having a first position fully present in said frame and a second position at least partly out of said frame and being movable outward from a front of said frame into the second position while coupled to said frame, said at least one drawer having a front face forming a front face of the piece of furniture.

11. The furniture assembly of claim 1, wherein said frame further comprises a wall section having front and rear surfaces defining a thickness therebetween and which forms at least part of said rear wall of the piece of furniture, said rear wall being a vertical rear wall of the piece of furniture.

12. The furniture assembly of claim 1, wherein said frame further comprises a panel under said upper panel, said second connector being connected to said panel.

13. The furniture assembly of claim 1, wherein said rear wall is substantially planar.

14. A furniture assembly, comprising:

a frame comprising:

a rear vertical wall of a piece of furniture;

an upper panel that defines an opening and an access door that controls access through said opening in said upper panel to a space under said upper panel in front of said rear wall; and an additional panel under said upper panel;

a bracket configured for attachment to a vertical support;

a first connector attached to said bracket, said rear wall including an aperture dimensioned to enable passage of at least part of said first connector therethrough from an area rearward of said rear wall into said space under said upper panel; and a second connector attached to said additional panel in a position to be in said space under said upper panel and that removably engages with said first connector when both are present in said space under said upper panel, at least one of said first and second connectors being length-adjustable relative to said bracket or said frame respectively to enable a distance between said frame and said bracket to be reduced, whereby a reduction in distance between said frame and said bracket, when said bracket is attached to the vertical support, and engagement between said first and second connectors prevents tipping of the piece of furniture.

15. The furniture assembly of claim 14, wherein said first connector comprises an elongate strap connected at one end region to said bracket and a buckle through which said first strap passes, said buckle being movable along said strap to vary a distance between said buckle and said bracket and thereby provide length adjustability to said first connector, whereby by pulling a free end of said strap relative to said buckle, a distance of said strap between said buckle and said bracket is reduced.

16. The furniture assembly of claim 15, wherein said second connector comprises an elongate strap connected at a first end region to said frame and a catch connected to a second end region of said strap of said second connector opposite said first end region of said strap of said second connector, said catch releasably engaging with said buckle.

17. The furniture assembly of claim 14, wherein said second connector comprises an elongate strap connected at a first end region to said frame and a catch connected to a second end region of said strap opposite said first end region of said strap.

18. The furniture assembly of claim 14, wherein said first connector comprises a first elongate strap connected at one end region to said bracket and a buckle through which said first strap passes, said buckle being movable along said first strap to vary a distance between said buckle and said bracket and thereby provide length adjustability to said first connector, whereby by pulling a free end of said first strap relative to said buckle, a distance of said first strap between said buckle and said bracket is reduced; and said second connector comprises a second elongate strap connected at a first end region to said frame and a catch connected to a second end region of said second strap opposite said first end region of said second strap, said catch being insertable into and removable from engagement with said buckle.

19. The furniture assembly of claim 14, further comprising an upper drawer immediately under said upper panel and movable into and at least partly out of said frame, said upper drawer having a depth such that when fully present in said frame, said space is behind said upper drawer and not obstructed by said upper drawer.

20. The furniture assembly of claim 19, further comprising at least one additional drawer below said upper drawer that has a larger depth than said upper drawer, said at least one additional drawer having a first position fully present in said frame and a second position at least partly out of said frame and being movable outward from a front of said frame into the second position while coupled to said frame, said at least one drawer having a front face forming a front face of the piece of furniture.

* * * * *